US009298140B2

(12) United States Patent
Moteki et al.

(10) Patent No.: US 9,298,140 B2
(45) Date of Patent: Mar. 29, 2016

(54) CONTROLLING APPARATUS, IMAGE HEATING APPARATUS AND IMAGE FORMING APPARATUS

(71) Applicant: CANON KABUSHIKI KAISHA, Tokyo (JP)

(72) Inventors: Junichi Moteki, Abiko (JP); Yasuharu Chiyoda, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/514,557

(22) Filed: Oct. 15, 2014

(65) Prior Publication Data

US 2015/0104205 A1 Apr. 16, 2015

(30) Foreign Application Priority Data

Oct. 16, 2013 (JP) ..... 2013-215387

(51) Int. Cl.
*G03G 15/20* (2006.01)
*G03G 15/00* (2006.01)

(52) U.S. Cl.
CPC ..... *G03G 15/2025* (2013.01); *G03G 15/6585* (2013.01)

(58) Field of Classification Search
CPC ..... G03G 15/2053; G03G 15/2025; G03G 15/2028; G03G 15/6585
USPC ..... 399/45, 320, 327
See application file for complete search history.

(56) References Cited

U.S. PATENT DOCUMENTS 8,145,086 B2 3/2012 Chiyoda et al.
8,306,446 B2 11/2012 Ito et al.
8,395,090 B2 3/2013 Chiyoda
8,873,986 B2 10/2014 Chiyoda
2011/0129266 A1* 6/2011 Maruko et al. ..... 399/328
2013/0051826 A1 2/2013 Chiyoda
2014/0270868 A1 9/2014 Chiyoda et al.
2015/0016831 A1 1/2015 Chiyoda

FOREIGN PATENT DOCUMENTS

JP 2008-40365 A 2/2008

OTHER PUBLICATIONS

U.S. Appl. No. 14/523,193, filed Oct. 24, 2014.

* cited by examiner

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

A controller for controlling an image heating device which includes first and second rollers for heating therebetween a toner image on a sheet, a first rubbing roller for rubbing the first roller, and a second rubbing roller for rubbing the second roller, said controller including a counter configured to count a number of heated sheets; a first executing portion configured to execute rubbing by the first rubbing roller in accordance with an output of the counter; a second executing portion configured to execute rubbing by the second rubbing roller in accordance with an output of the counter; an acquiring portion execution instructions of an image glossiness improving mode operation provided by an operator; and a determination portion configured to determine which roller or rollers of the first second rollers is to be rubbed in accordance with an output of the counter, when the acquiring portion acquires the execution instructions.

18 Claims, 15 Drawing Sheets

CONTROLLING APPARATUS, IMAGE HEATING APPARATUS AND IMAGE FORMING APPARATUS

FIELD OF THE INVENTION AND RELATED ART

The present invention relates to a controlling apparatus, an image heating apparatus, and an image forming apparatus.

In the filed of an image forming apparatus which uses an electrophotographic image forming method or the like, it has been a common practice to form an image on a sheet of recording paper with the use of toner, and fix the toner image to the sheet of recording paper with the use of a fixing apparatus (image heating apparatus), more concretely, a pair of rotational components, that is, a fixation roller and a pressure roller.

The contact between the peripheral surface of a fixation roller and a sheet of recording paper tends to create numerous minute peaks and valleys across the peripheral surface of the fixation roller. More concretely, as a fixation roller repeatedly comes into contact with sheets of recording paper, the portions of the peripheral surface of the fixation roller, which correspond in position to the edges of the sheet of recording medium, in terms of the recording paper conveyance direction, become recessive compared to the rest of the peripheral surface of the fixation roller. In other words, they sustain numerous minute scars (which hereafter may be referred to as "paper edge scars, or simply, edge scars"). As the number of times the fixation roller comes into contact with sheets of recording paper increases, these recesses tend to leave their impression across the toner image on the sheet of recording paper. This property of the peripheral surface of the fixation roller may be referred to as "surface texture transferability", hereafter. In recent years, there have been made a substantial amount of improvement in the field of a fixation roller, in particular, in terms of the smoothness of its peripheral surface, being thereby increased in "surface texture transferability". Therefore, from the standpoint of forming a highly glossy image of high quality, it has become increasingly important for a fixation roller to be reliably maintained at a desired level in terms of surface condition.

There have been available the following documents which are related to means for maintaining a fixation roller in terms of surface properties to prevent a fixing apparatus from yielding an image which is nonuniform in gloss. In the case of Japanese Laid-open Patent Application 2008-40365, in order to prevent the fixing device from outputting images which are nonuniform in gloss, a rotational abrasive component, the peripheral surface of which is covered with abrasive particles which are in a range of #1000-#4000 in particles size, is used to give the peripheral surface of the fixation roller fine scars, in order to make inconspicuous the minute scratches made by sheets of recording paper across the peripheral surface of the fixation roller.

Further, the fixing device disclosed in Japanese Laid-open Patent Application 2008-40365159 is structured so that when the fixation roller is not abraded, the rotational abrasive component is kept separated from the fixation roller, in order to minimize the amount by which offset toner adheres to the rotational abrasive component, and also, that as no less than a preset number of sheet of recording paper are conveyed, for fixation, through the fixing device, the rotational abrasive component is automatically placed in contact with the fixation roller to abrade the peripheral surface of the fixation roller.

As the inventors of the present invention, their colleagues, etc., studied a case in which a fixing device is also provided with a rotational abrasive component for its pressure roller, it was found that the following problems would possibly occur.

First, the primary reason why a pressure roller also has to be abraded is that the paper dust from recording paper cumulatively adheres to the peripheral surface of the pressure roller. As paper dust accumulates on the peripheral surface of a pressure roller, it is possible that while an image forming apparatus is operated in the two-sided image forming operation, the paper dust will transfer onto the image on the first surface of a sheet of recording medium, and therefore, the image on the first surface of a sheet of recording paper will be reduced in image quality.

On the other hand, paper dust is unlikely to accumulate on the peripheral surface of the fixation roller (portion of peripheral surface of fixation roller, which is actually used for fixation), because when the fixation roller comes into contact with a sheet of recording paper, there is a toner image between the fixation roller and the sheet. On the other hand, certain portions of the peripheral surface of a fixation are made to recess by their contact with the side (lateral) edges of a sheet of recording paper, as described above. Therefore, it is desired that the peripheral surface of a fixation roller also is periodically abraded.

As described above, the reason why a fixation roller is to be abraded across its peripheral surface is different from the reason why a pressure roller is to be abraded across its peripheral surface. Thus, a fixation and a pressure roller are inevitably different in the timing with which they are to be abraded (although it is possible that they will become the same in abrasion timing every so often).

If a fixing device is structured, based on the above described background information, so that both the fixation roller and pressure roller of a fixing device are unconditionally abraded in response to a command from a user, it is possible for the following problems to occur. For example, if a fixing device is forced to perform an abrading operation in spite of the fact that the pressure roller has just been abraded, the pressure roller will be excessively abraded, which results in unnecessary reduction in the length of service of the pressure roller 51. This problem applies to the fixation roller as well.

SUMMARY OF THE INVENTION

According to an aspect of the present invention, there is provided a controlling apparatus for controlling an image heating apparatus, said image heating apparatus including first and second rotatable members for heating therebetween a toner image on a sheet, a first rubbing rotatable member for rubbing said first rotatable member, and a second rubbing rotatable member for rubbing said second rotatable member, said controlling apparatus comprising a counter configured to count a number of heated sheets; a first executing portion configured to execute rubbing by said first rubbing rotatable member in accordance with an output of said counter; a second executing portion configured to execute rubbing by said second rubbing rotatable member in accordance with an output of said counter; an acquiring portion execution instructions of an operation in an image glossiness property improving mode provided by an operator; and a determination portion configured to determine which rotatable member or rotatable members of said first rotatable member and said second rotatable member is to be rubbed in accordance with an output of said counter, when said acquiring portion acquires the execution instructions.

According to another aspect of the present invention, there is provided an image heating apparatus comprising first and second rotatable members configured to heat therebetween a toner image on a sheet; a first rubbing configured to rub said first rotatable member; a second rubbing rotatable member configured to rub said second rotatable member; a counter configured to count a number of heated sheets; a first executing portion configured to execute rubbing by said first rubbing rotatable member in accordance with an output of said counter; a second executing portion configured to execute rubbing by said second rubbing rotatable member in accordance with an output of said counter; an acquiring portion execution instructions of an operation in an image glossiness property improving mode provided by an operator; and a determination portion configured to determine which rotatable member or rotatable members of said first rotatable member and said second rotatable member is to be rubbed in accordance with an output of said counter, when said acquiring portion acquires the execution instructions.

According to a further aspect of the present invention, there is provided an image forming apparatus comprising an image forming station configured to form a toner image on a sheet; first and second rotatable members configured to heat therebetween the toner image formed by said image forming station on the sheet; a first rubbing configured to rub said first rotatable member; a second rubbing rotatable member configured to rub said second rotatable member; a counter configured to count a number of heated sheets; a first executing portion configured to execute rubbing by said first rubbing rotatable member in accordance with an output of said counter; a second executing portion configured to execute rubbing by said second rubbing rotatable member in accordance with an output of said counter; an operating portion configured to instruct, by an operator, execution of an operation in a mode for improving a glossiness property of the image; and a determination portion configured to determine which rotatable member or rotatable members of said first rotatable member and said second rotatable member is to be rubbed in accordance with an output of said counter, when execution of the operation in the mode is instructed by said operating portion.

Further features of the present invention will become apparent from the following description of exemplary embodiments (with reference to the attached drawings).

DESCRIPTION OF THE PREFERRED EMBODIMENTS

Hereinafter, the present invention is concretely described with reference to some of the most preferable embodiments of the present invention. However, these embodiments are not intended to limit the present invention in scope.

<<Embodiment 1>>

(Image Forming Apparatus)

Figure 2:
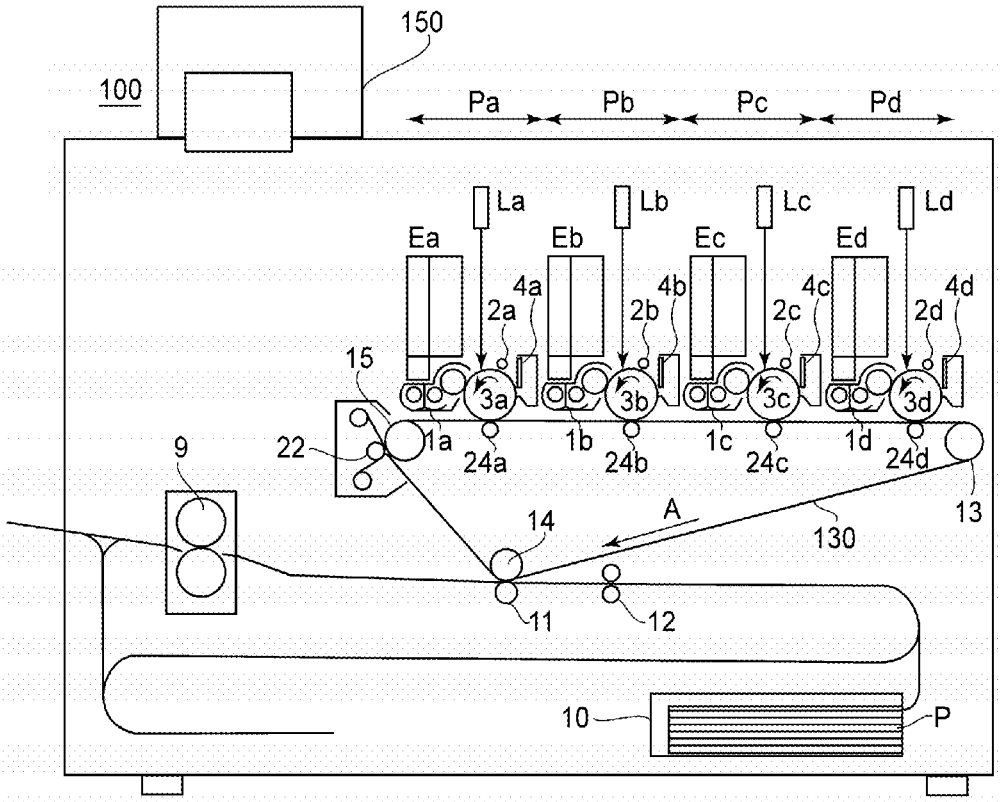
FIG. 2 is a sectional view of an image forming apparatus equipped with a controlling apparatus (device) for controlling its fixing device, which shows the general structure of the image forming apparatus.

FIG. 2 is a sectional view of the image forming apparatus equipped with a controlling apparatus (device) for controlling the fixing apparatus (device) in this embodiment. It shows the general structure of the apparatus. The image forming apparatus 100 is a full-color laser beam printer, which uses an electrophotographic image forming method. There are disposed in tandem the first, second, third, and fourth image forming sections Pa-Pd, in the main assemble of the apparatus. In the image forming sections Pa-Pd, monochromatic toner images, which are different in color, are formed one for one, through processes of forming a latent image, developing the latent image, and transferring the developed latent image.

The image forming sections Pa-Pd have drum-shaped electrophotographic photosensitive components, more specifically, photosensitive drums 3*a*-3*d* as their own image bearing components, respectively. The photosensitive drums 3*a*-3*d* are rotationally driven in the direction indicated by arrow marks R1 in FIG. 2, at a preset peripheral velocity. It is on these photosensitive drums 3*a*-3*d* that monochromatic toner images, different in color, are formed one for one.

There is disposed next to the photosensitive drums 3*a*-3*d*, an intermediary transfer belt 130, as an intermediary transferring component. As the toner images, different in color, are formed on the photosensitive drums 3*a*-3*d*, one for one, they are transferred (primary transfer) onto the intermediary transfer belt 130, in the primary transfer sections N1*a*-N1*d*, respectively. Then, they are transferred (secondary transfer) onto a sheet P of recording paper, in the secondary transfer section N2.

After the transfer of the toner images onto the sheet P of recording paper, the sheet P is conveyed to a fixing apparatus (device) 9, in which the sheet P and the toner images thereon are subjected to heat and pressure. Thus, the toner images become fixed to the sheet P. Thereafter, the sheet P is discharged, as a print, from the main assembly of the apparatus.

The image forming sections Pa-Pd are also provided with charge rollers 2*a*-2*d* as charging means, and developing devices 1*a*-1*d* as developing means, which are disposed in the adjacencies of the photosensitive drums 3*a*-3*d*, respectively. Also disposed in the adjacencies of the photosensitive drums 3*a*-3*d* are primary transfer rollers 24*a*-24*d* as primary transferring means, and cleaners 4*a*-4*d* as cleaning means. Further, there are disposed above the photosensitive drums 3*a*-3*d*, laser scanners La-Ld, as exposing means, which are equipped with a light source and a polygonal mirror.

The photosensitive drums 3*a*-3*d* are roughly uniformly charged by the charge rollers 2*a*-2*d*, respectively. Then, the charged portion of each photosensitive drum 3 is exposed by the laser scanner L (La, Lb, Lc or Ld). A beam of laser light emitted by the light source is deflected by a rotating polygon mirror in a manner of scanning the charged portion of the photosensitive drum 3, is changed in direction by a reflection mirror, and is focused by an f-θ lens onto the generatrix of the photosensitive drum 3 (3*a*, 3*b*, 3*c* or 3*d*). Consequently, four electrostatic images (latent images), which correspond to the image formation signals, are effected on the photosensitive drums 3*a*-3*d*, one for one.

The developing devices 1*a*-1*d* contain a preset amount of yellow, magenta, cyan, and black toners, as developer), respectively. They are replenished with toner, as necessary, by replenishing devices 117*a*-117*d*, respectively. They develop the latent images on the photosensitive drums 3*a*-3*d* into visible images, more specifically, yellow, magenta, cyan and black toner images, respectively.

The intermediary transfer belt 130 is being rotationally driven, in the direction indicated by an arrow mark A, at the same peripheral velocity as the photosensitive drums 3*a*-3*d*. In an operation for forming a full-color image, for example, first, a yellow toner image (image of first color) is formed on the photosensitive drum 3*a*. This yellow toner image is transferred (primary transfer) onto the outward surface of the intermediary transfer belt 130 (with reference to loop which belt forms), while the yellow toner image is conveyed through the nip (primary transfer nip) N1*a*, which is the area of contact between the photosensitive drum 3*a* and intermediary transfer belt 130.

While the yellow toner image is conveyed through the primary transfer nip N1*a*, the primary transfer bias is applied to the intermediary transfer belt 130 by way of the primary transfer roller 24*a*. Thus, the yellow toner image on the photosensitive drum 3*a* is transferred onto the intermediary transfer belt 130 by the combination of the electric field generated by the primary transfer bias, and the pressure in the primary transfer nip N1*a*. Similarly, the magenta toner image (toner image of second color), cyan toner image (toner image of third color), and black toner image (toner image of fourth color) are sequentially transferred in layers onto the intermediary transfer belt 130. Consequently, a full-color image, which reflects the image formation signals, are synthetically formed.

The secondary transfer section is provided with the secondary transfer roller 11 as a secondary transferring means which is supported by a pair of bearings, in parallel to the intermediary transfer belt 130, and also, in contact with the downwardly facing portion of the outward surface of the intermediary transfer belt 130. To the secondary transfer roller 11, a preset secondary transfer bias is applied by a secondary transfer bias power source.

Meanwhile, sheets P of recording paper are conveyed to the secondary transfer section by a recording paper supplying means. More specifically, the sheets P are conveyed one by one to the secondary transfer nip from a sheet feeder cassette 10, by way of a pair of registration rollers 12, an upstream transfer guide (unshown), etc., with such a timing that each sheet P of recording paper arrives at a preset point in time, at the secondary transfer nip, which is the area of contact between the intermediary transfer belt 130 and secondary transfer roller 11. While the sheet P is conveyed through the secondary transfer nip, the secondary transfer bias is applied to the secondary transfer roller 11 from a secondary transfer bias power source. Thus, the synthetic full-color toner image, which is made up of the four monochromatic toner images, different in color, which were transferred in layers onto the intermediary transfer belt 130, is transferred (secondary transfer) onto the sheet P or recording paper.

By the way, the toner (transfer residual toner) which is remaining on the photosensitive drums 3*a*-3*d* after the completion of the primary transfer, is removed and recovered by the cleaners 4*a*-4*d*. That is, the photosensitive drums 3*a*-3*d* are cleaned so that they can be used for the formation of the next latent images. As for the transfer residual toner, and other contaminants, remaining on the intermediary transfer belt 130, they are wiped way by a cleaning web (unwoven cloth) which is placed in contact with the surface of the intermediary transfer belt 130.

After the transfer of the toner images onto the sheet P of recording paper, in the second transfer section, the sheet P is introduced into a fixing device 9, which will be described later in detail. In the fixing device 9, heat and pressure are applied to the sheet P and toner image(s) thereon. Consequently, the toner image(s) becomes fixed to the sheet P.

(Image Heating Apparatus, and Controlling Apparatus for Image Heating Apparatus)

In this embodiment, the controlling apparatus (device) for controlling the fixing device as an image heating device is provided with an automatic mode and a user mode (manual mode), which will be described later. The controlling device may be a part of an image forming apparatus, like the one in this embodiment, or a part of a fixing device, like the one with which a fixing device is provided in a case where the fixing device is independent from the image forming apparatus.

Figure 3:
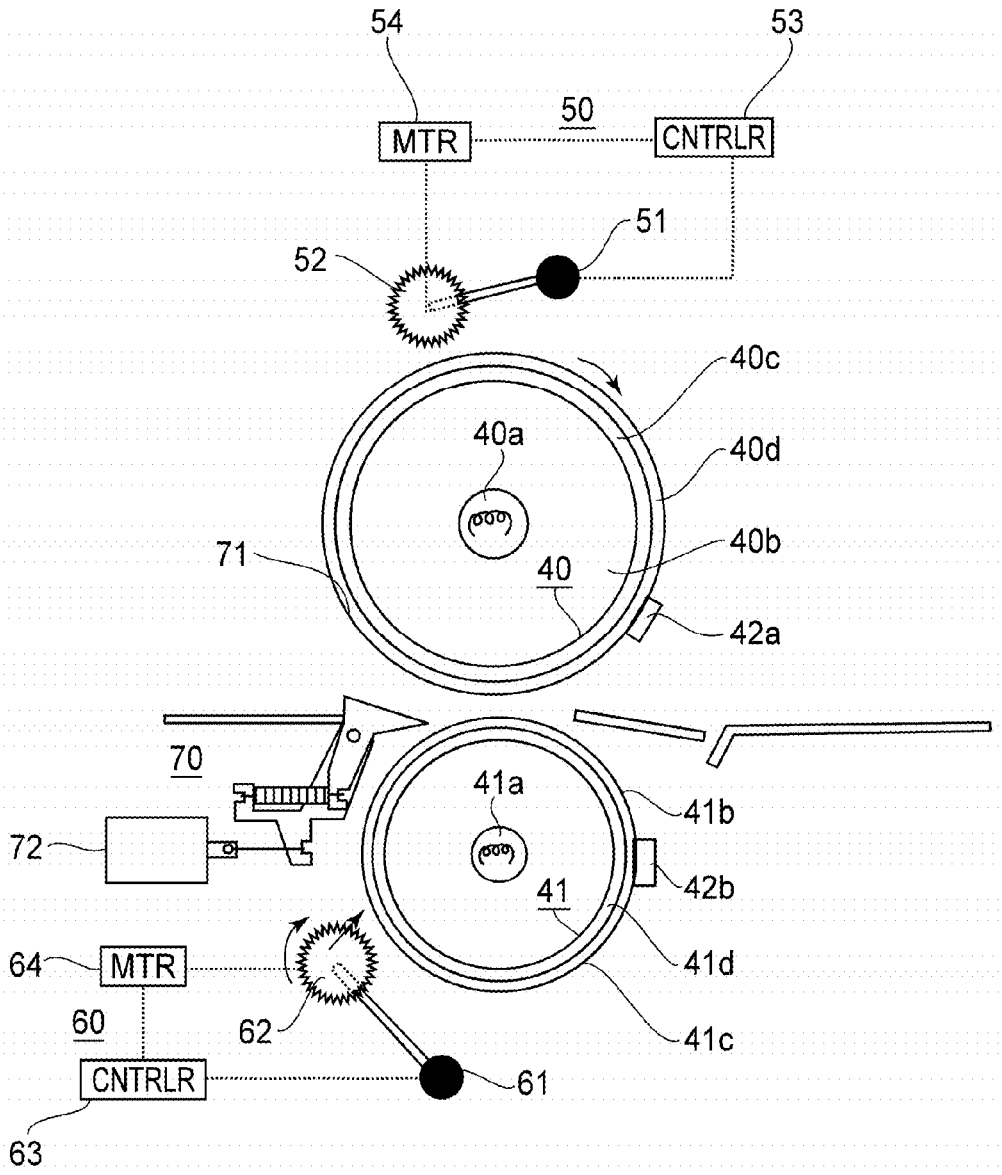
FIG. 3 is a sectional view of the fixing device while the fixing device 5 is not being made, by the controlling device, to carry out an operation for refreshing its fixation roller, nor an operation for refreshing its pressure roller.

FIG. 3 is a sectional view of the fixing device 9, while it is not in the state in which it can perform neither an operation for refreshing the fixation roller, nor an operation for refreshing the pressure roller. It shows the structure of the fixing device 9. The fixing device 9 has a fixation roller (thermally fixing component) 40, which is a rotational heating component (first rotational component) for heating the image on a sheet P of recording paper. The fixing device 9 has also a pressure roller (pneumatic fixing component) 41, which is a rotational pressure applying component (second rotational component). It is pressed upon the fixation roller 40 to form a nip (fixation nip). As a sheet P of recording paper, on which a toner image is present, is conveyed through the fixation nip, remaining pinched between the pressure roller 41 and fixation roller 40, while the fixation roller 40 is heated by a heat source 40*a* disposed in the hollow of the fixation roller 40, the toner image becomes fixed to the sheet P.

Further, the fixing device 9 is provided with a fixation roller refreshing system 50, which can be placed in contact with, or separated from, the fixation roller 40. It is also provided with a pressure roller refreshing system 60, which can be placed in contact with, or separated from, the pressure roller 41.

1. Fixation Roller

Referring to FIG. 3, the fixation roller 40 is made up of a metallic core (sustratative layer) 40*b*, an elastic layer 40*c*, and a parting layer 40*d*. The elastic layer 40*c* is formed of rubber, on the peripheral surface of the metallic core 40*b*. The parting layer 40*d* is the surface layer of the fixation roller 40. It covers the elastic layer 40*c*. More concretely, in this embodiment, the metallic core 40*b* is a piece of hollow aluminum tube which is 68 mm in external diameter. The elastic layer 40*c* is formed of silicone rubber, and is 20° in rubber hardness (JIS-A: under 1 kg of weight), and is 1.0 mm in thickness. The parting layer 40*d*, which covers the outward surface of the elastic layer 40*c*, is formed of fluorinated resin, and is 50 μm in thickness. Thus, the fixation roller 40 is 70 mm in external diameter.

The fixation roller 40 is rotatably supported by a pair of supporting components located at the lengthwise ends of the metallic core 40*b* (in terms of direction parallel to rotational axis of metallic core 40*b*). It is rotationally driven by an unshown motor as a driving means, in the direction indicated by an arrow mark in FIG. 3.

The material for the parting layer is a piece of tube made of fluorinated resin, such as PFA resin (copolymer of tetrafluoroethylene resin and perfluoroalkoxylethylene), PTFE (tetrafluoroethylene), or the like, which is excellent in parting properties. The material for the parting layer of the fixation roller 40 in this embodiment is a piece of PFA resin tube. The parting layer 40*d*, which is the surface layer of the fixation roller 40 is desired to be no less than 30 μm, and no more than 100 μm, in thickness.

The fixation roller 40 internally holds a halogen heater 40*a* as its heat source. Its temperature is kept by a combination of a temperature sensor 42*a* and a temperature control circuit, within a range of 150-180° C., in which toner is fixable to a sheet P of recording paper. This target temperature has to be varied according to recording paper type.

By the way, in this embodiment, the peripheral velocity of the fixation roller 40 was set to 220 mm/sec. This peripheral velocity of the fixation roller 40 is equivalent to the process speed (image outputting speed) of the image forming apparatus 100.

2. Surface Condition of Fixation Roller

At this time, the changes in the surface condition of the fixation roller 40, which are caused by a sheet P of recording medium as the sheet P is conveyed through the fixing device 9, are described. Hereafter, the portions of the peripheral surface of the fixation roller 40, which the side edges (lateral edges) of a sheet P of recording paper contact, are referred to as paper edge portions. As the problem that the peripheral surface of the fixation roller 40 is gradually roughened by the side edges (lateral edges) of a sheet of recording paper was examined by the inventors of the present invention, the following became evident.

That is, as a substantial number of sheets P of recording paper are conveyed through the fixing device 9 in such a manner that the sheets always contact the same portion of the fixation roller 40 in terms of the lengthwise direction of the fixation roller 40, the peripheral surface of the fixation roller 40 becomes nonuniform in surface roughness, as will be described next. That is, referring to FIG. 8, the paper path portion (I), out-of-paper-path portions (II), and paper edge portions (III), or the borderline between the paper path portion (I) and out-of-paper-path portion (II), of the peripheral surface of the fixation roller 40, become different in surface roughness.

When the fixation roller 40 is in the new condition, the peripheral surface of the fixation roller 40, which is the outward surface of the parting layer formed of fluorinated resin or the like, is in the mirror-like condition; the surface roughness Rz (JIS: ten point average roughness) is roughly in a range of 0.1 μm-0.3 μm. In comparison, as a substantial number of sheets P of recording paper are conveyed through the fixing device 9, the portion of the peripheral surface of the fixation roller 40, which corresponds in position to the recording paper path (portion which comes into contact with recording paper) is gradually eroded by being attacked by the fibers, internal and external additives of the recording paper. Thus, the surface roughness of this portion of the fixation roller 40 gradually increases to roughly 0.5 μm-1.0 μm.

The out-of-paper-path portions (II) of the peripheral surface 40*d* of the fixation roller 40 contact the peripheral surface 41*d* of the pressure roller 41 which opposes the fixation roller 40. Thus, the surface roughness Rz of the out-of-paper-path portions (II) of the peripheral surface of the fixation roller 40 settles to a value in a range of 0.4 μm-0.7 μm. Thus, the peripheral surface of the fixation roller 40 is made nonuniform in surface condition, in terms of the lengthwise direction of the fixation roller 40, by the conveyance of sheets P of recording paper through the fixing device 9, as described above.

Figure 8:
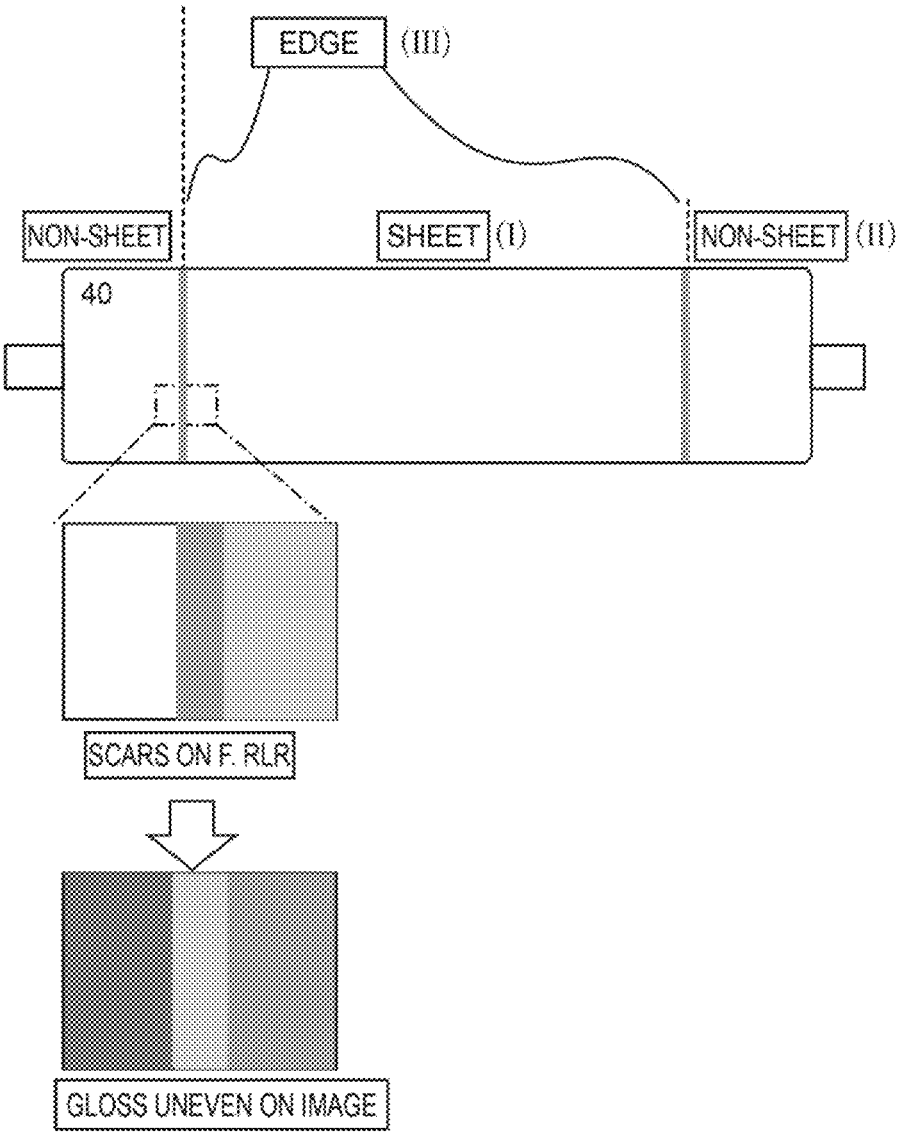
FIG. 8 is an enlarged view of one of the paper edge scars of the fixation roller of the fixing device, which is for describing the paper edge scar in detail.

Next, the relationship between the condition of the peripheral surface of the fixation roller 40 and the nonuniformity in gloss of an image outputted from the fixation roller 40 is described. In order to fix an unfixed toner image to a sheet P of recording paper, the fixing device 9 applies pressure and heat to the sheet P and the unfixed toner image thereon. During this process, the surface condition (presence of numerous minute peaks and valleys) of the peripheral surface of the fixing device 9 is transferred onto the surface of the toner image as the sheet P is conveyed through the fixing device 9. Thus, the surface condition of the peripheral surface of the fixation roller 40, more specifically, the nonuniformity of the peripheral surface of the fixation roller 40, makes the toner image on a sheet P of recording paper nonuniform in surface condition while the sheet P is conveyed through the fixing device 9. Consequently, the image forming apparatus 100 outputs images which are nonuniform in gloss (FIG. 8).

Generally speaking, with regards to surface gloss, if a surface is capable of highly accurately reflecting an optical image, the surface is recognized as highly glossy, whereas if a surface is incapable of highly accurately reflecting an optical image, it is recognized as low in gloss or not glossy. For example, in a case where an image such as a silver-salt photographic image is seen under florescent illumination, not only is the light from the florescent bulb reflected by the image surface, but also, the shape of the florescent bulb can be seen in the image surface. In such a case, the image is thought to be highly glossy, whether consciously or unconsciously. This means that the surface of the photographic image is in the mirror-like condition, that is, being virtually free of visible peaks and valleys.

On the other hand, if a surface is low in gloss, the opposites can be said. That is, in the case of an image which is low in gloss, the minute peaks and valleys which its surface has are relatively large. Therefore, as the light from a florescent bulb hits the surface, it is randomly reflected, and therefore, the shape of the florescent bulb is not recognizable in the surface of the image. That is, there is a correlation between the surface condition (presence of minute peaks and valleys) of an image, and the glossiness of the image.

Therefore, if a fixation roller having deteriorated in surface condition is used to fix an image to highly glossy recording medium, such as coated paper, which is used to yield high quality images, an image forming apparatus (fixing device) is likely to output images which are nonuniform in gloss. For example, an image forming apparatus (fixing device) is likely to output images which have unwanted lines which are low in gloss and correspond in position to the paper edge portions of the fixation roller 40, images which are nonuniform in gloss because of the difference in gloss between its portion corresponding to the paper-path portion of the fixation roller, and its portions corresponding to the out-of-sheet-path portions of the fixation roller, and the like images.

Hereafter, the difference in gloss between a portion of an image, which corresponds in position to the paper edge portion (III) of the fixation roller 40, and the portion of the image, which corresponds in position to the sheet-path portion (I) of the fixation roller, is referred to as a paper edge scar, and so is the difference in gloss between the portion of an image, which corresponds in position to the paper edge portion (III) of the fixation roller. In comparison, the difference in gloss between the portion of an image, which corresponds in position to the paper-path portion (I) of the fixation roller, and the portion of the image, which corresponds in position to the out-of-sheet-path portion (II) of the fixation roller is referred to as gloss nonuniformity.

The sheet edge portion (III) is roughly 1-2 mm in width. That is, it is very narrow. Therefore, the difference in gloss between the portion of an image, which corresponds in position to the paper-path (I) of the peripheral surface of the fixation roller 40, and the portion of the image, which corresponds in position to the out-of-paper-path portions (II) of the fixation roller 40, is more conspicuous than the paper edge scars, regardless of severity in roughness of the sheet edge portions of the fixation roller.

3. Fixation Roller Refreshing System

Figure 4:
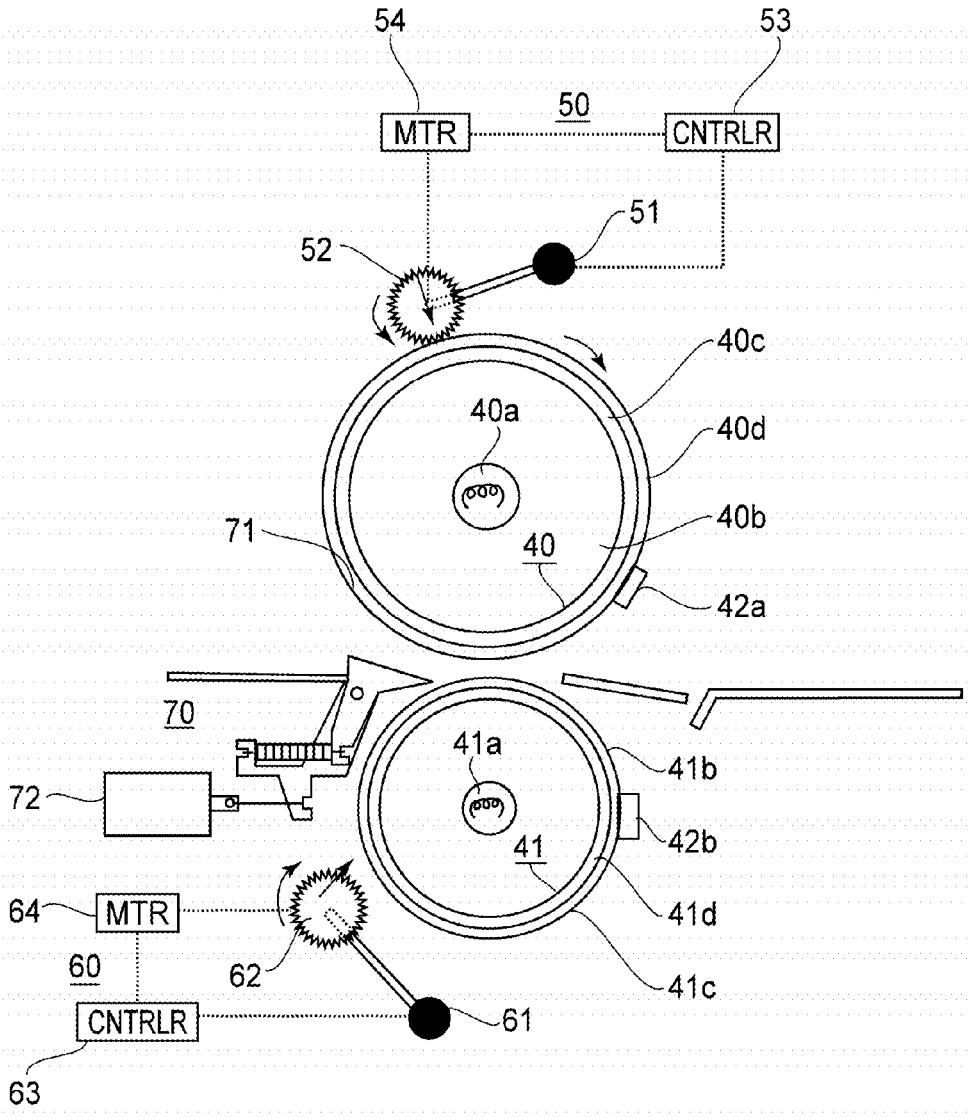
FIG. 4 is a sectional view of the fixing device while the fixing device is being made, by the controlling device, to carrying out an operation for refreshing its fixation roller.

At this time, the fixation roller refreshing system 50 is described. Referring to FIG. 4, a refreshing roller (abrading roller) 52, which is an abrading component (first rotational abrading component), is made up of a metallic (stainless steel SUS 304) core 53 which is 12 mm in external diameter, and an abrasive layer (surface layer) 55 which covers the peripheral surface of the metallic core 53. More concretely, the abrasive layer 55 is formed by forming an adhesive layer (intermediary layer) 54 on the peripheral surface of the metallic core 53, and then, densely adhering abrasive particles, as abrasive material, to the adhesive layer 54 (peripheral surface of the metallic core 53.

Figure 7:
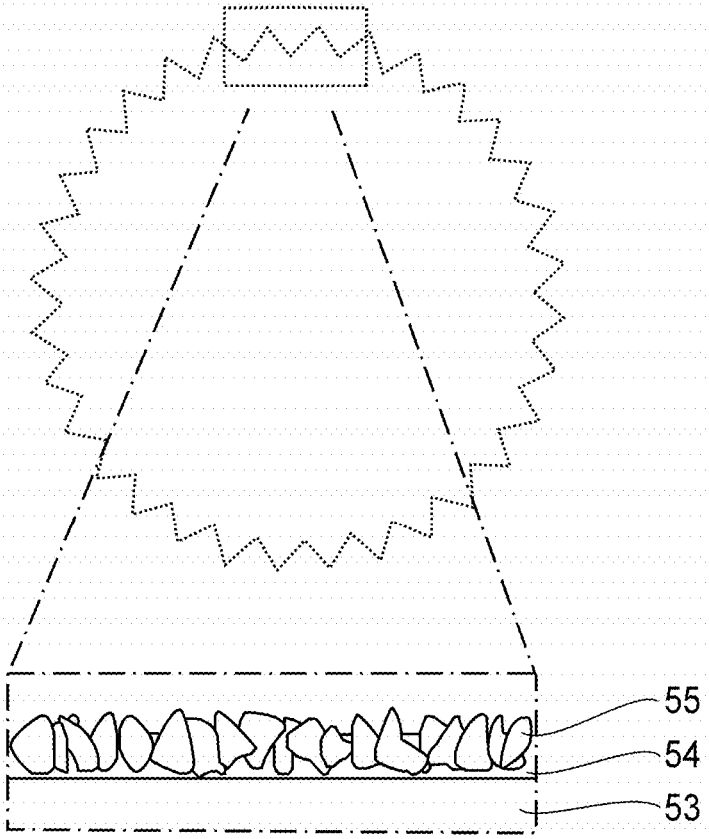
FIG. 7 is an enlarged sectional view of a part of the peripheral portion of the refresh roller of the fixing device.

FIG. 7 is an enlarged schematic sectional view of the refreshing roller 52. As the abrasive 55 of which the abrasive layer 33 (surface layer) of the refreshing roller 52 is formed, minute particles of one of the following substances, and their mixtures, can be listed. More specifically, minute particles of aluminum oxide, aluminum hydroxide, silicon oxide, cerium oxide, titanium oxide, zirconia, lithium silicate, silicon nitride, iron oxide, chrome oxide, antimony oxide, diamond, etc., may be listed.

In this embodiment, alumina (aluminum oxide) (which is referred to as Alundum or Morundum) was used as the abrasive 55. Alumina-based abrasive is the most widely used abrasive. It is substantially higher in hardness than the fixation roller 40. Further, its edges are acute-angled. Therefore, it is excellent in terms of abrasiveness. Thus, it is suitable as the abrasive 55 for this embodiment. The alumina-based abrasive used for this embodiment was no less than 5 μm and no more than 20 μm in particles size. Thus, the abrasive layer 33 is such a layer that is no less than 5 μm and no more than 20 μm in thickness. This range (5 μm and no more than 20 μm in thickness) was a range in which the refreshing roller 52 can effectively refresh the fixation roller 40 in surface condition, while keeping the fixation roller 40 satisfactory in surface properties.

The refreshing roller 52 is rotatably supported by a pair of supporting components located at the lengthwise (parallel to rotational axis of roller) ends of the metallic core 53. Referring to FIG. 4, the refreshing roller 52 is rotationally drivable by a motor 54 as a driving means. Further, the supporting components located at the lengthwise ends, one for one, of the refreshing roller 52 are kept under the pressure generated by a pair of compression springs (unshown) as pressure applying means. Therefore, the refreshing roller 52 is pressed upon the pressure roller 41 by a preset amount of pressure.

Therefore, an abrading nip, which has a preset width in terms of the rotational direction of the refreshing roller 52 and fixation roller 40, is formed between the refreshing roller 52 and fixation roller 40. The refreshing roller 52 may be rotated either in such a direction that makes the refreshing roller 52 and fixation roller 40 the same, or opposite, in the direction in which their peripheral surface moves in the area of contact (abrading section) between the refreshing roller 52 and fixation roller 40. Further, the refreshing roller 52 is disposed so that it can be placed in contact with, or separated from, the fixation roller 40 by a refreshing roller positioning mechanism.

4. Pressure Roller

Referring to FIG. 3, the pressure roller 41 is made up of a metallic core (sustrative layer) 41*b*, an elastic layer 41*c*, and a parting layer 41*d*. The elastic layer 41*c* is formed of rubber, on the peripheral surface of the metallic core 41*b*. The parting layer 41*d* is the surface layer of the pressure roller 41, and covers the elastic layer 41*c*. More concretely, in this embodiment, the metallic core 41*b* is a piece of hollow aluminum tube which is 48 mm in external diameter. The elastic layer 41*c* is formed of silicone rubber and is 20° in rubber hardness (JIS-A: under 1 kg of weight), and is 2.0 mm in thickness. The parting layer 41*d*, which covers the outward surface of the elastic layer 41*c*, is formed of fluorinated resin, and is 50 μm in thickness. Thus, the pressure roller 41 is 50 mm in external diameter. The pressure roller 41 is rotatably supported by a pair of supporting components located at the lengthwise (direction parallel to axial line of metallic core) ends of the metallic core 40*b*.

The pair of pressure roller supporting components located at the lengthwise ends of the pressure roller 41 are kept pressed by a pair of compression springs (unshown), as pressure applying means, one for one. Thus, the pressure roller 41 remains pressed upon the fixation roller 40 by a preset amount of pressure. Therefore, a fixation nip, which has a preset width in terms of the direction in which the peripheral surface of the fixation roller 40 and that of the pressure roller 41 move, is formed between the fixation roller 40 and pressure roller 41. In this embodiment, the total amount of pressure by which the pressure roller 41 is kept pressed upon the fixation roller 40 is 800 N.

The pressure roller 41 internally holds a halogen heater 41*a* as a heat source. Its temperature is kept by a combination of a temperature sensor 42*b* and a temperature control circuit, within a range of 90-110° C., which does not make the first and second surfaces of a sheet P of recording paper different in gloss in the two-sided mode, and also, the pressure roller 41 does not substantially reduce the fixation roller 40 in temperature. If the temperature of the pressure roller 41 substantially exceeds its target level, the pressure roller 41 is cooled by an unshown cooling fan or the like to reduce the temperature of the pressure roller 41 to the target level. This target temperature level is varied according to recording paper type, or the like factor.

5. Surface Condition of Pressure Roller

At this time, the changes in the surface condition of the fixation roller 40, which are caused by a sheet P of recording medium as the sheet P is conveyed through the fixing device 9, are described. There is a problem that as the fixing device 9 increases in the cumulative number of times sheets P of recording medium were conveyed through the fixing device 9, the peripheral surface of the pressure roller 41 is gradually roughened by the contaminants such as paper dust. Thus, the inventors of the present invention studied the adhesion of paper dust to the pressure roller 41. As a result, the following became evident. By the way, the frequency with which the pressure roller 41 comes into contact with the toner image on a sheet P of recording medium is less than the frequency with which the fixation roller 40 does. Therefore, it may be said that the pressure roller 41 is smaller than the fixation roller 40, in terms of the effect they have upon the above described paper edge scars, which results in the formation of images which are nonuniform in gloss.

Each time a sheet P of recording paper moves through the fixation nip, calcium carbonate, and the like, which are ingredients of the paper dust which originates from the sheet P, adhere to the surface layer of the pressure roller 41, although by an extremely small amount. The surface layer of the pressure roller 41, which is formed of fluorinated resin, is excellent in parting properties. Normally, therefore, it is unlikely that the paper accumulates on the peripheral surface of the pressure roller 41. However, the temperature of the pressure roller 41 is kept relatively low as described above. In the case of the fixation roller 40, there is a toner image between the fixation roller 40 and a sheet P of recording paper. Therefore, it may be said that the amount by which paper dust ingredients adhere to the fixation roller 40 will be very small.

As the amount of the paper dust having adhered to the peripheral surface of the pressure roller 41 exceeds a certain value, the pressure roller 41 substantially loses its parting properties. Consequently, the paper dust begins to accelerated accumulate on the peripheral surface of the pressure roller 41.

Figure 9:
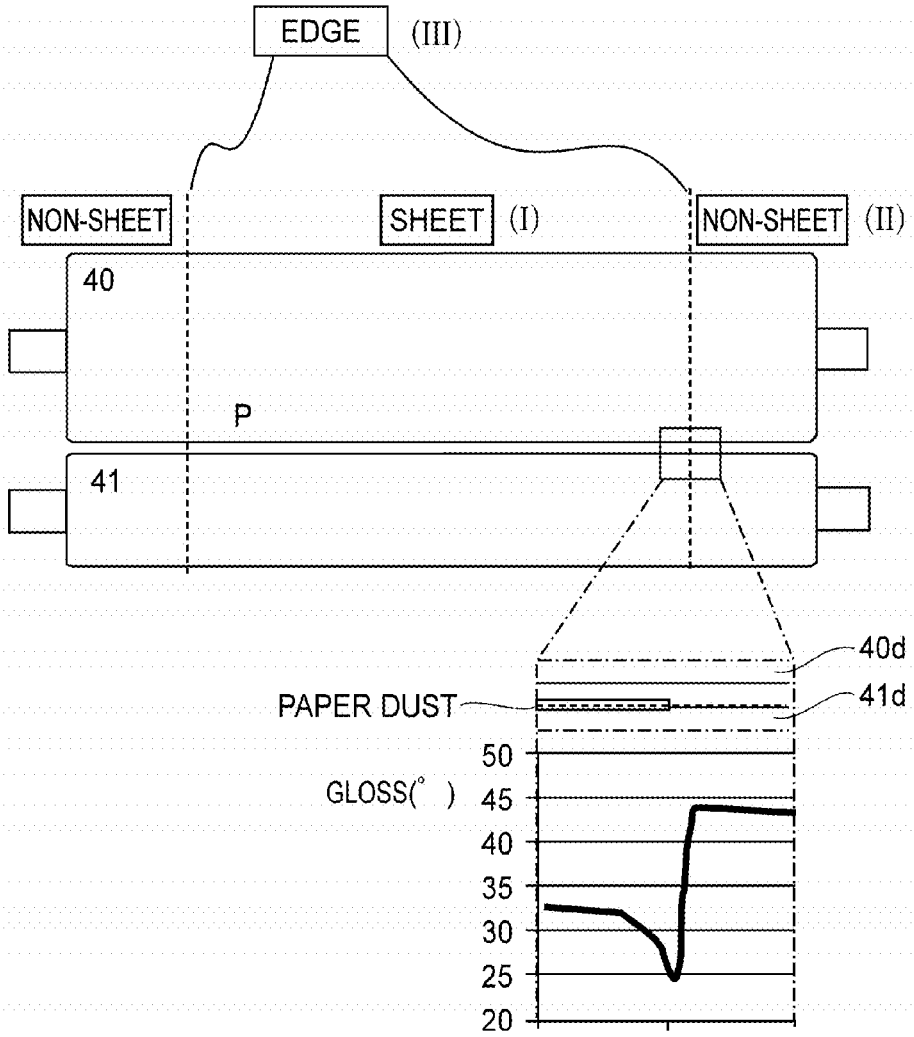
FIG. 9 is an enlarged view of a portion of the peripheral surface of the pressure roller of the fixing device, which is covered with paper dust.

FIG. 9 is an enlarged view of the paper edge portions of the peripheral surface of the fixation roller 40 and those of the pressure roller 41, and their adjacencies, It shows the paper dust on the pressure roller 41. More specifically, after a substantial amount of paper dust adhered to this portion of the pressure roller 41, a sheet of glossy paper (coated paper) was used to form a monochromatic black toner image on both the first and second surfaces the sheet. Then, the glossiness of the toner image on the first surface was measured. Then, the obtained values were plotted along the points of measurement of the fixation roller 40. As is evident from FIG. 9, as a given point of the peripheral surface of the pressure roller 41 reduces in surface roughness due to the paper dust adhesion, it reduces in fixation performance (ability to conduct heat to toner). Thus, the point of the resultant image, which corresponds to the given point, is significantly less in gloss.

6. Separation Claw Mechanism

Figure 5:
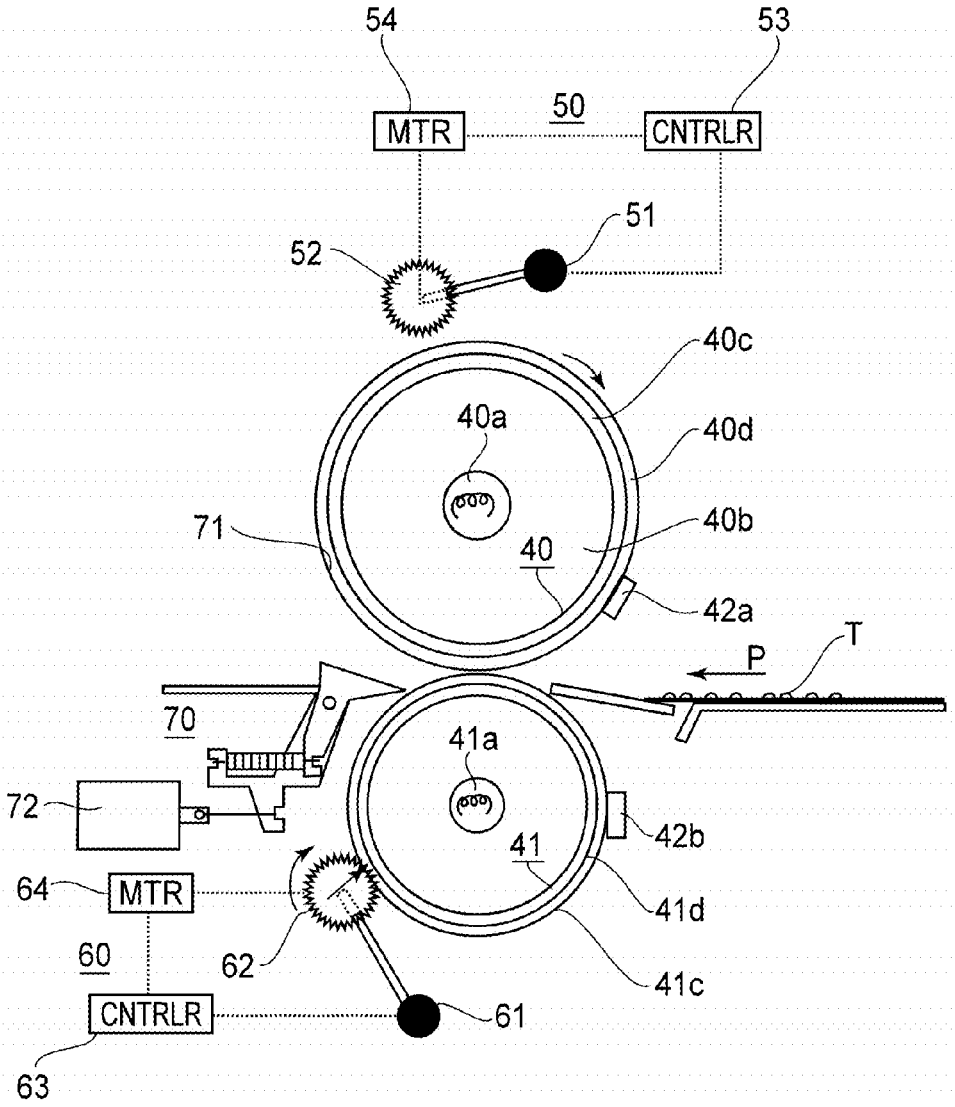
FIG. 5 is a sectional view of the fixing device while the fixing device is being made by the controlling device to carrying out an operation for refreshing its pressure roller.
Figure 10:
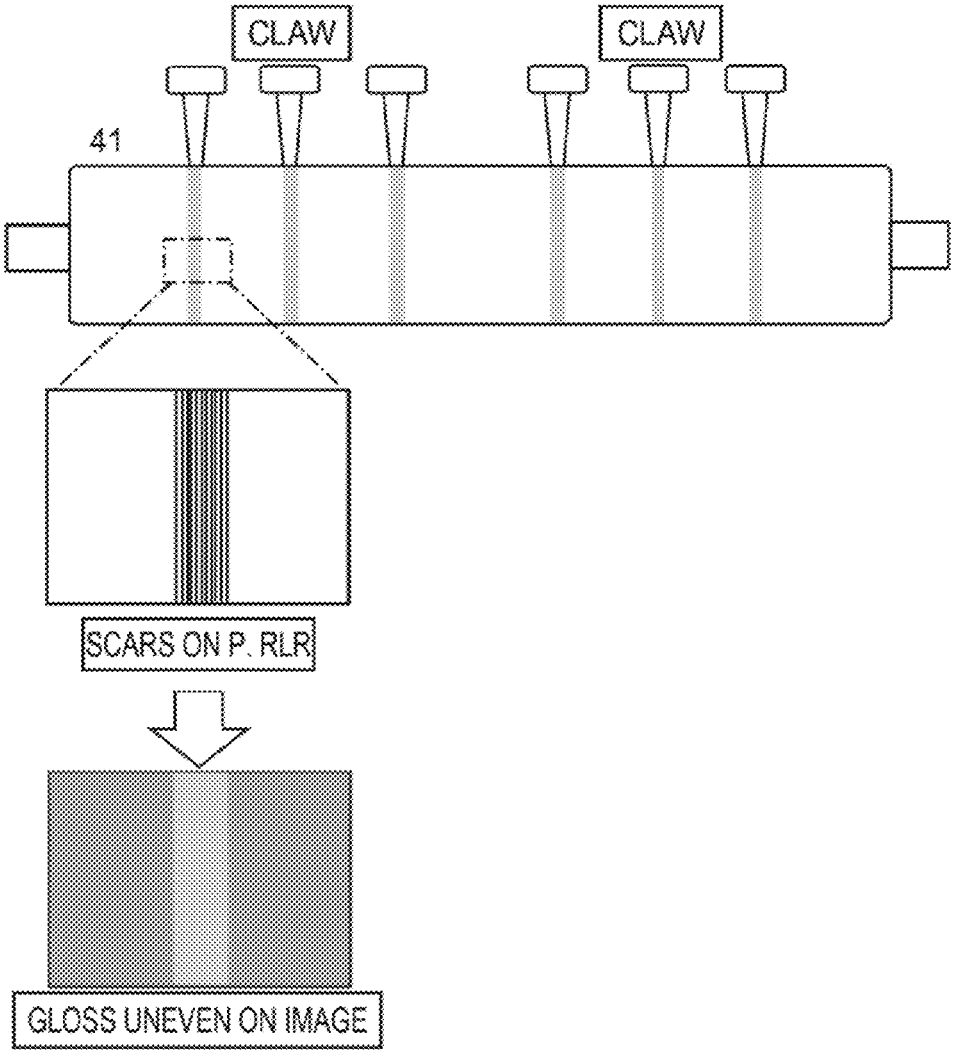
FIG. 10 is an enlarged view of the separation claw scars on the pressure roller of the fixing device.

Next, a separation claw mechanism 70, which is a sheet separating unit, is described. Referring to FIG. 5, the fixing device 9 is provided with multiple separation claws 71, which are disposed in the adjacencies of the pressure roller 41, being aligned in tandem in the lengthwise direction of the pressure roller 41, as shown in FIG. 10. The separation claws 71 prevent a sheet P of recording paper from wrapping around the pressure roller 41, by being placed in contact with the peripheral surface of the pressure roller 41, when the sheet P is discharged from the fixation nip while remaining in contact with the pressure roller 41.

A sheet P of recording paper, which is high in rigidity, is less likely to wrap around the pressure roller 41 at the sheet exit of the fixation nip. Therefore, when the sheets P of recording paper which are used for an image forming operation is higher in rigidity than a certain value, it is unnecessary for the separation claws 71 to be placed in contact with the pressure roller 41. Thus, the fixing device 9 is structured so that the separation claws 7 can be placed in contact with, or separated from, the peripheral surface of the pressure roller 41. It is impossible to accurately obtain the rigidity of a sheet of recording paper. In this embodiment, therefore, whether the separation claws 71 need to be placed in contact with, or kept separated from, the peripheral surface of the pressure roller 41, is determined based on whether or not the recording paper is coated paper, and/or based on the basis weight of the recording paper.

Further, in a case where a toner image is present on the surface of a sheet P of recording medium, which is facing the pressure roller 41, as when the image forming apparatus 100 is in the two-sided image forming mode, the adhesiveness of the toner image comes into play. Therefore, it is more likely for the sheet P to wrap around the peripheral surface of the pressure roller 41. Thus, when the image forming apparatus 100 is in the two-sided mode which makes it likely for a toner image to be on the surface of a sheet P of recording medium, which is facing the pressure roller 41, the separation claws 71 are placed in contact with, or kept separated from, the peripheral surface of the pressure roller 41, based on Table 1 (which shows, in numerical value, conditions in which separation claws are to be placed in contact with, or kept separated, from pressure roller), in which "ordinary paper" includes high quality paper with no coating, recycled paper, and the like, and "other" includes all the other categories of sheet of recording medium such as a sheet of plastic film for an overhead projector which does not belong to the "coated paper" category.

TABLE 1

| | ON/OFF Separation Claw | | | |
|---|---|---|---|---|
| | ON | | OFF | |
| Kinds of sheets | 1st | 2nd | 1st | 2nd |
| Plain paper | - 105 gsm | - 105 gsm | 106 gsm - | 106 gsm - |
| Coated paper | - 105 gsm | - 128 gsm | 106 gsm - | 129 gsm - |
| Other | - 128 gsm | - 135 gsm | 129 gsm - | 136 gsm - |

7. Pressure Roller Refreshing Mechanism

Next, a system 60 for refreshing the pressure roller 41 is described. Referring to FIG. 5, a refreshing roller 62 (roughening roller) which is an abrading component (second rotational abrading component) is made up of a metallic (stainless steel SUS 304) core 53 which is 12 mm in external diameter, and an abrasive layer (surface layer) 33 which covers the peripheral surface of the metallic core 53. More concretely, the abrasive layer 33 was formed by forming an adhesive layer (intermediary layer) 54 on the peripheral surface of the metallic core 53, and then, densely adhering abrasive particles, as abrasive material, to the adhesive layer 54 (peripheral surface of the metallic core 53.

FIG. 7 is an enlarged schematic sectional view of the refreshing roller 62. As the abrasive 55 of which abrasive layer 33 (surface layer) of the refreshing roller 62 is formed, minute particles of the following substances, and their mixtures, can be listed. More specifically, minute particles of aluminum oxide, aluminum hydroxide, silicon oxide, cerium oxide, titanium oxide, zirconia, lithium silicate, silicon nitride, iron oxide, chrome oxide, antimony oxide, diamond, etc., may be listed.

In this embodiment, alumina (aluminum oxide) (which is referred to as Alundum or Morundum) was used as the abrasive 55. Alumina-based abrasive is the most widely used abrasive. It is substantially higher in hardness than the pressure roller 41. Further, its edges are acutely angled. Therefore, it is excellent in terms of abrasiveness. Thus, it is suitable as the abrasive 55 for this embodiment.

The alumina-based abrasive used for this embodiment was no less than 5 μm and no more than 20 μm in particles size. Thus, the abrasive layer 33 is such a layer that is no less than 5 μm and no more than 20 μm in thickness. This range (5 μm and no more than 20 μm in thickness) was in a range in which refreshing roller 61 can effectively refresh the pressure roller 41 in surface condition, while keeping the pressure roller 41 satisfactory in surface properties.

Figure 6:
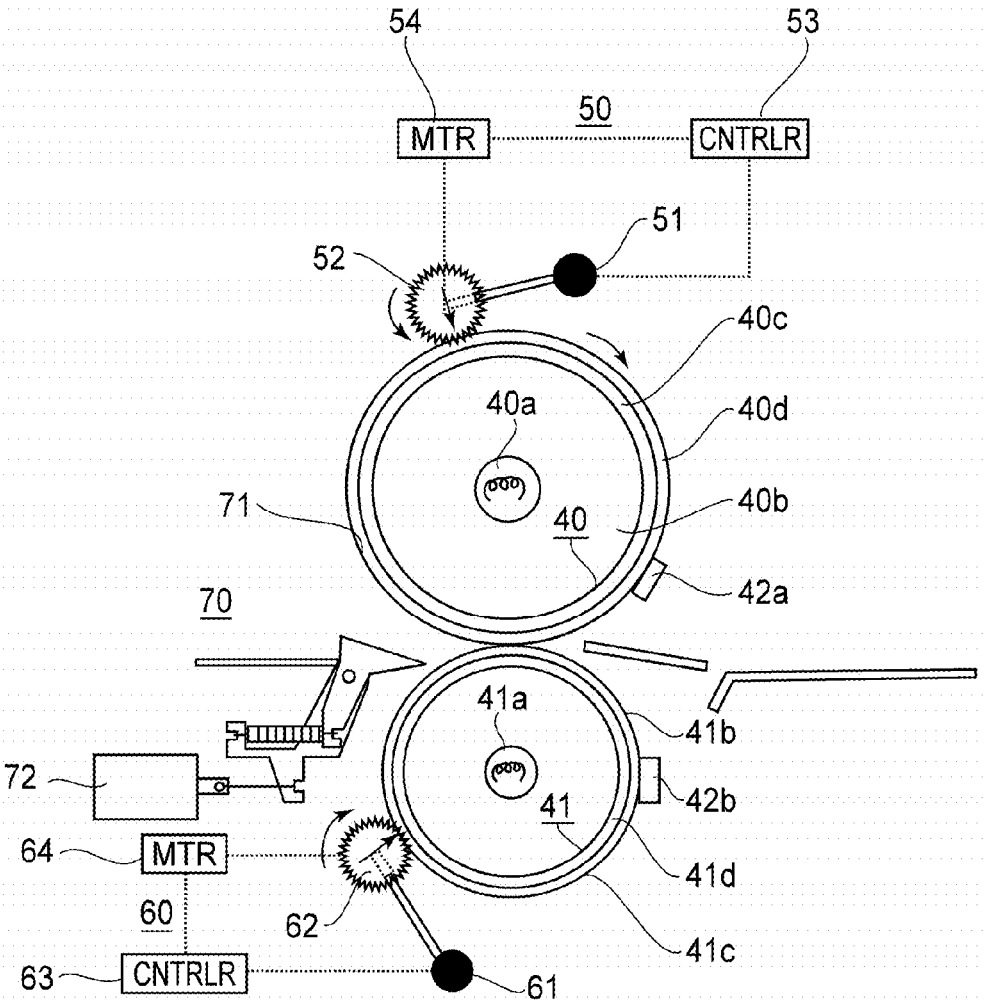
FIG. 6 is a sectional view of the fixing device while the fixing device is being made by the controlling device to carrying out both an operation for refreshing its fixation roller and an operation for refreshing its pressure roller at the same time.

The refreshing roller 62 is rotatably supported by a pair of supporting components located at the lengthwise (parallel to rotational axis of refreshing roller) ends of the metallic core 53. Referring to FIG. 6, the refreshing roller 62 is rotationally drivable by a motor 54 as a driving means. Further, the supporting components located at the lengthwise ends, one for one, of the refreshing roller 62 are under the pressure generated by a pair of compression springs (unshown) as pressure applying means. Therefore, the refreshing roller 62 is pressed upon the pressure roller 41 by a preset amount of pressure.

Therefore, an abrading nip, which has a preset width in terms of the rotational direction of the refreshing roller 62 and pressure roller 41, is formed between the refreshing roller 62 and pressure roller 41. The refreshing roller 62 may be rotated either in such a direction that makes the refreshing roller 62 and pressure roller 41 the same, or opposite, in the direction in which their peripheral surface moves in the area of contact (abrading section) between the refreshing roller 62 and pressure roller 41. Further, the refreshing roller 62 is disposed so that it can be placed in contact with, or separated from, the pressure roller 41 by a refreshing roller positioning mechanism 61.

8. Difference Between Fixation Roller 40 and Pressure Roller 41 in Terms of Surface Layer Condition As described above, the fixation roller 40 and pressure roller 41 are different from each other in the reason why their surface layer changes in condition. The fixation roller 40 is higher in a target temperature level for their temperature control. That is, the fixation roller 40 melts toner to fix the toner to a sheet of recording paper. Therefore, the changes in the surface roughness of the fixation roller 40 is more likely to affect the gloss which the image on the sheet P will be given while the sheet P is conveyed through the fixation nip, than those of the pressure roller 41. In other words, if paper edges scars are made by the pressure roller 41, they are likely to be inconspicuous, but if they are made by the fixation roller 40, they are likely to be recognized as nonuniformity in gloss.

Further in the case of a fixing device such as the one in this embodiment which is for forming high quality images which are highly glossy, the fixing device 9 is operated without placing the separating components in contact with the fixation roller 40. In such a case, the accumulation of paper dust on the pressure roller 41, and the pressure roller scars attributable to the separation claws are the primary factors which affect the nonuniformity in image gloss.

The amount by which paper dust is generated by each sheet P of recording medium is extremely small. It is unlikely for paper dust to adhere to the peripheral surface of the fixation roller 40, while it is used for toner image fixation. In comparison, the peripheral surface of the pressure roller 41 comes into contact with the surface of each sheet P of recording paper, which does not have a toner image. Therefore, it is likely for paper dust to adhere to the peripheral surface of the pressure roller 41. If paper dust collects on the peripheral surface of the pressure roller 41, the surface layer of the pressure roller 41 reduces in parting properties, even if the paper dust layer is very thin. Thus, once a paper dust layer is formed on the peripheral surface of the pressure roller 41, it becomes easier for paper dust, toner, etc., to adhere to the peripheral surface of the pressure roller 41. Therefore, when the image forming apparatus 100 is operated in the two-sided mode, the paper dust on the peripheral surface of the pressure roller 41 transfers onto the image on the first surface of a sheet P of recording medium, possibly reducing the image in quality.

As described above, the fixation roller 40 and pressure roller 41 are different from each other in the reason why their peripheral surface changes in condition. Therefore, the fixation roller 40 and pressure roller 41 are made different in the timing with which their peripheral surface (surface layer) is abraded (refreshed). That is, the operation for refreshing (abrading) the fixation roller 40 and that for refreshing (abrading) the pressure roller 41 are independently controlled from each other.

9. Refreshing Operation

In this embodiment, three types of nonuniformity in the texture of the peripheral surface of the fixation roller 40 and pressure roller 41 are eliminated with the use of the refreshing rollers 52 and 62. The first nonuniformity is attributable to the transfer of the scars, which the peripheral surface of the fixation roller 40 sustained as the peripheral surface of the fixation roller 40 came into contact with the side (lateral) edges of a sheet P of recording paper, onto the image surface. The second nonuniformity is attributable to the transfer of the scars which the peripheral surface of the pressure roller 41 is made to sustain by the separation claws 71, as the pressure roller 41 was rotated while the separation claws 71 were in contact with the peripheral surface of the pressure roller 41, onto the image. The third nonuniformity is attributable to the deterioration of the surface properties of the pressure roller 41, which was caused by the paper dust, etc., having adhered to the peripheral surface of the pressure roller 41 while sheets P of recording paper are conveyed through the fixation nip.

In order to prevent the image forming apparatus 100 from outputting images which suffer from one or more of the abovementioned three types of nonuniformity, the fixation roller refreshing system 50 and pressure roller refreshing system 60 are controlled by the controlling device for controlling the fixing device 9. More specifically, the fixation roller 40 and pressure roller 41 are abraded by the refreshing rollers 52 and 62, respectively, to cover the entirety of the peripheral surface of fixation roller 40 and the entirety of the peripheral surface of the pressure roller 41, in terms of their lengthwise direction, to virtually eliminate the distance between the adjacent peak and valley, in terms of the direction parallel to the radius direction of the two rollers 40 and 41. Further, the minute amount of paper dust and the like contaminants having adhered to the surface layer of the pressure roller 41 are scraped away. This is how the image forming apparatus 100 is prevented from outputting images which suffer from streaks which are lower in gloss than their adjacencies, and the difference in gloss between the portion of the image, which corresponds in position to the recording paper path portion of the fixation roller 40 and/or pressure roller 41, and the portions of the image, which correspond in position to the out-of-paper-path portions of the fixation roller 40 and/or pressure roller 41.

Further, after the peripheral surface of the fixation roller 40 and that of the pressure roller 41 are given numerous minute scratches by the refreshing rollers 52 and 62, the impression of the preexisting scars and scratches of the peripheral surface of the fixation roller 40 and those on the pressure roller 41, on the surface of the fixed image are unrecognizable. More concretely, the fixation roller 40 and pressure roller 41, the surface layer, that is, the parting layer, of which is formed of fluorinated resin or the like substance, is roughly 0.1 μm-0.3 μm in surface roughness Rz, across their out-of-paper-path portions, and roughly 0.5 μm-2.0 μm in surface roughness across their paper-path portion. In comparison, the portions of the peripheral surface of the pressure roller 41, which was made to deteriorate in surface properties, by their contact with the paper edges, separation claws, and also, the adhesion of paper dust thereto, are roughly 1.0-4.0 μm in surface roughness Rz.

Therefore, the fixation roller 40 and pressure roller 41 were refreshed by the refresh rollers 52 and 62 so that their peripheral surface becomes no less than 0.5 μm and no more than 2.0 μm in surface roughness Rz. By the way, the instrument used for measuring the surface roughness Rz of the two rollers 40 and 41 was a surface roughness gauge SE-3400 (product of Kosaka Laboratory Co., Ltd.). The condition under which the surface roughness of the two rollers 40 and 41 was measured was 0.5 mm/s in speed, 0.8 mm in cutoff, and 2.5 mm in measurement length.

It is unnecessary for the refresh rollers 52 and 62 to continuously rub (abrade) the fixation roller 40 and pressure roller 41, respectively, throughout a given image forming operation. For example, the fixing device 9 may be equipped with a sheet counter so that a refreshing (abrading) operation will be automatically and periodically performed for every preset number of sheets P of recording paper. Also, the control panel of the image forming apparatus 100 may be provided with a button for making the apparatus to start operating in the user mode, in order to enable a user to make the apparatus to perform a refreshing operation as the image nonuniformity becomes noticeable. Therefore, the fixing device 9 in this embodiment is provided with a mechanism for placing the refreshing rollers 52 and 62 in contact with, or keep the refreshing rollers 52 and 62 separated from, the fixation roller 40 and pressure roller 41, respectively.

Referring to FIGS. 3 and 4, the operation of the mechanism 51, which is for placing the refreshing roller 52 in contact with, or separating and keeping separated the refreshing roller 52 from, the fixation roller 40, is controlled by the controller 53 (controlling means) of the fixation roller refreshing system 50. Further, the controller 53 controls the operation of the motor 54 which transmits rotational driving force to the refreshing roller 52 in order to rotate the refreshing roller 52 for a preset length of time.

Next, referring to FIGS. 3 and 5, the pressure roller refreshing system 60 uses the controller 53 (controlling means) to activate the mechanism 61 for placing the refreshing roller 6 in contact with, or separating and keeping separated from, the pressure roller 41. Further, the controller 63 controls the operation of the motor 64 which transmits rotational driving force to the refreshing roller 63, in order to rotate the refreshing roller 63 for a preset length of time.

As described above, in this embodiment, the fixing device 9 is structured so that its fixation roller refreshing roller 52 can be placed in contact with, or separated, and kept separated, from, the fixation roller 40, and also, so that its pressure roller refreshing roller 63 can be placed in contact with, or separated, and kept separated, from, the pressure roller 41. Thus, the fixation roller 40 and pressure roller 41 can be improved in peripheral surface properties by the placement of the two refreshing rollers 52 and 62 in contact with the fixation roller 40 and pressure roller 41, respectively, for a desired length of time, with a desired timing, with the use of the fixation roller refreshing system 50 and pressure roller refreshing system 60, when the two rollers 52 and 62 are on standby, that is, when they are remaining separated from the fixation roller 40 and pressure roller 41, respectively.

By the way, in this embodiment, the motors 54 and 64 were provided as means for transmitting rotational driving force to the refreshing rollers 52 and 62, respectively. However, the fixing device 9 may be structured so that the rotational driving force is transmitted from the pressure roller 41 by way of a driving gear.

10. Surface Contamination of Refreshing Roller

Figure 11:
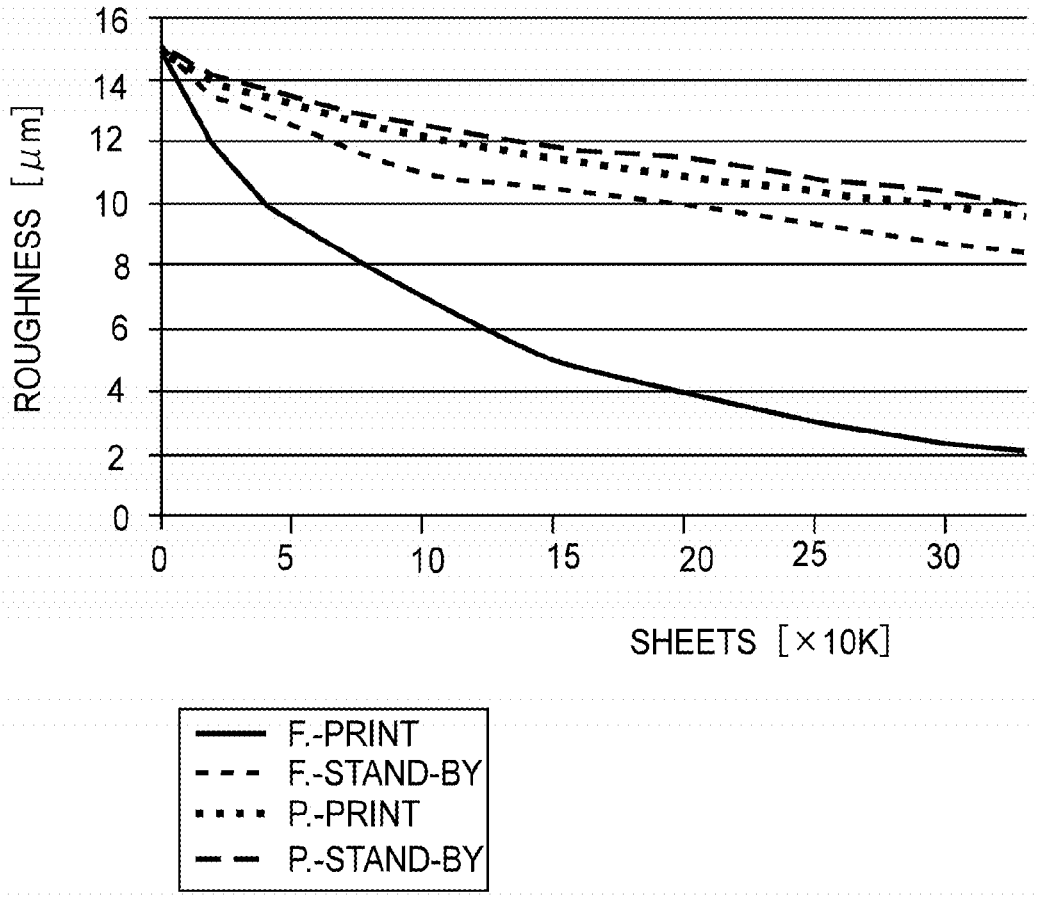
FIG. 11 is a graph for showing the relationship among the surface roughness of the refresh rollers, the number of sheets of recording paper conveyed through the fixing device, and the amount of refresh roller contamination.

FIG. 11 shows the changes in surface roughness Rz of the surface layer of the refreshing rollers 52 and 62, which occurs when the refreshing operation was carried out for five seconds for every 500 sheets of recording paper while sheets of recording paper of size A4, on each of which a monochromatic halftone image, which is roughly 0.5 in image data density, is present were conveyed through the fixation nip.

"Fixing component-during printing" refers to a case in which an operation for refreshing the fixation roller 40 was carried out without interrupting the on-going image forming operation. "Fixing component-on standby" refers to a case in which the operation for refreshing the fixation roller 40 was carried out while the image forming apparatus 100 was kept on standby (printing operation was interrupted). "Pressing component-during printing" refers to a case in which an operation for refreshing the pressure roller 41 was carried out without interrupting the on-going printing operation. "Pressing component-on standby" refers to a case in which the operation for refreshing the pressure roller 41 was carried out while the image forming apparatus 100 was kept on standby (printing operation was interrupted).

As the surface layer of the refreshing roller reduces in its surface roughness, it reduces in its refreshing performance as well. Thus, in order to improve (restore) the refreshing rollers 52 and 62 in the surface condition of their surface layer, the refreshing rollers 52 and 62 have to be resurfaced so that their surface roughness Rz becomes no less than 7-8 μm. This has been found out through experiments. With reference to these values, in the case of the refreshing roller 62 for the pressure roller 41, whether the pressure roller refreshing operation was carried out without interrupting the on-going printing operation, or while the image forming apparatus 100 was on standby, made hardly any difference.

In comparison, in the case of the refreshing roller 52 for the fixation roller 40, when the refreshing operation was carried out without interrupting the on-going printing operation, the surface roughness of the fixation roller 40 fell below the referential values, as slightly less than 100,000 sheets of recording paper were conveyed through the fixing device 9. This is less by ⅓ than when the refreshing operation was carried out while the image forming apparatus 100 was kept on standby.

This reduction in surface roughness is attributable to the phenomenon that the peripheral surface of the refreshing roller 52 is packed with the toner having offset to the peripheral surface of the fixation roller 40, paper dust, and the like contaminants. Moreover, after the refreshing roller 52 reduced in surface roughness, the peripheral surface of the refreshing roller 52 had the same color as the toner. Thus, the following are evident from these results. That is, in a case where the operation for refreshing the refreshing roller 52 is carried out without interrupting the on-going printing operation, contaminants adhere to the peripheral surface of the refreshing roller 52. Therefore, the fixation roller 40 reduces in the surface roughness. Thus, in a case where the operation for refreshing the fixation roller 40 without interrupting the on-going printing operation, the fixation roller 40 reduces in surface roughness faster than in the case where the operation is carried out while the image forming apparatus 100 is kept on standby.

In other words, it is evident that it is desirable that the operation for refreshing the fixation roller 40 is carried out after the on-going printing operation ends, or temporarily interrupted. That is, it is evident that it is desirable that the operation for refreshing the fixation roller 40 is carried out after the on-going job (printing operation) in which sheets of recording paper are conveyed through the nip (fixation nip) is interrupted. By the way, instead of interrupting the job in which sheets of recording paper are conveyed through the nip (fixation nip), the operation for refreshing the fixation roller 40 may be carried out between two jobs which are to be sequentially carried out.

In comparison, as for the operation for refreshing the pressure roller 41, whether it is carried out without interruption of the on-going printing operation, or while the image forming apparatus 100 is kept on standby, had little to do with the effectiveness of the pressure roller refreshing operation. That is, even if the operation for refreshing the pressure roller 41 is carried out without the interruption of the on-going printing operation, there will be no problem.

The reason why the peripheral surface of the pressure roller 41 is not contaminated during a printing operation is thought to be as follows. That is, as the toner on a sheet of recording paper is heated in the fixation nip which the fixation roller 40 and pressure roller 41 form, it melts, and then, is fixed to the sheet P. During this process, most of the toner is fixed to the sheet P. However, it is possible that a small amount of the toner will offset onto the fixation roller 40. This phenomenon is referred to as "hot offset". Regarding this "hot offset", the higher in temperature the fixation roller 40, with which toner comes into contact, the more likely for the surface of each toner particle to be excessively melted, and therefore, the smaller the adhesive force between adjacent two toner particles. Therefore, the more likely for the toner to offset onto the fixation roller 40.

On the other hand, in the case of the pressure roller 41, when the image forming apparatus 100 is in the one-sided mode, the surface of a sheet P of recording paper, on which an image is not present, comes into contact with the pressure roller 41. Therefore, "hot offset" does not occur. Further, in a case where the image forming apparatus 100 is in the two-sided mode, the surface (first surface) of a sheet P of recording medium, on which a fixed toner image is present, comes into contact with the pressure roller 41. However, the target temperature level for the pressure roller 41 is very low compared to that for the fixation roller 40. In addition, the toner image on the first surface of the sheet P melted and solidified while it was fixed. Therefore, it is unlikely for toner to hot-offset onto the pressure roller 41.

11. Refreshment Sequence (Automatic Mode)

Figure 13:
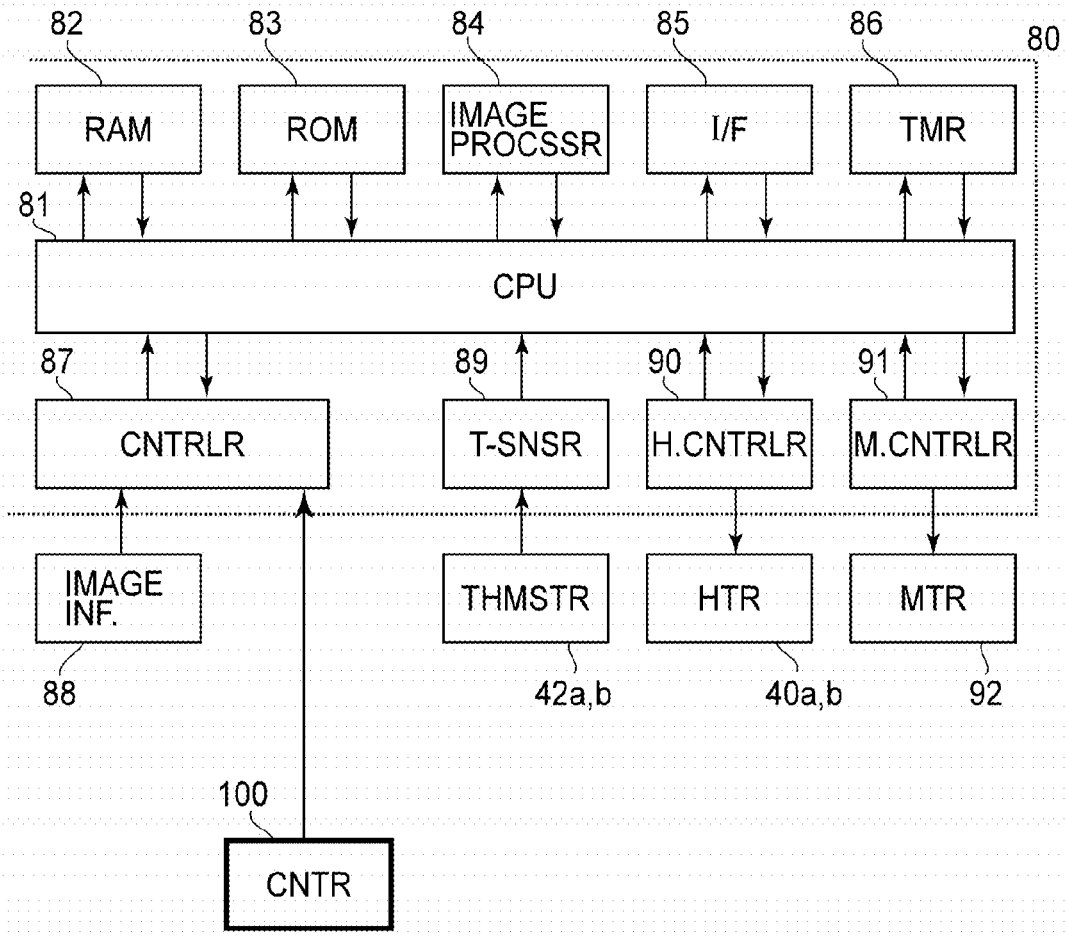
FIG. 13 is a block diagram of the control device for controlling the fixing device.

FIG. 13 is a block diagram of the system for refreshing the fixation roller 40 and/or pressure roller 41, which can be set to an automatic mode or a user (manual) mode, which will be described later.

Each signal is process by the CPU 81 as a part of a control system (controlling means), to control the aforementioned motors and heaters. This CPU 81 functions also as an obtaining portion for obtaining a command (signal) for making the image forming apparatus 100 (fixing device 9) operate in the mode for improving the image forming apparatus 100 in terms of image glossiness. First, the refreshment sequence carried out in the automatic mode is described, with reference to the flowchart for the automatic mode, with the use of the flowchart in FIG. 12, and Table (which contains threshold values for deciding whether or not refreshment sequence is to be carried out).

Here, the automatic mode is different from the user mode in that in the user mode, each time a refresh key, with which the control panel, as inputting means, is provided, is pressed (touched), the CPU 81 decides which refreshment sequence is to be carried out, and makes the fixing device 9 carry out the selected refreshment sequence, whereas in the automatic mode, each time the CPU 81, which functions also as an executing portion, decides whether or not the fixation roller refreshing operation and/or pressure roller refreshing operation is to be carried out, each time the value in the counter which functions as a part of computing portion, reaches the threshold value. Then, the CPU 81 makes the image forming apparatus 100 (fixing device 9) carry out one or both of the refreshment sequences. Incidentally, the calculating portion is equipped with three counters.

TABLE 2

| | | threshold | Execution duration per one |
|---|---|---|---|
| Fixing roller | Width counter | 3000 sheets | 60 sec |
| Pressing roller | Passed sheet counter | 500 sheets | 10 sec |
| | Claw-on time counter | 300 sec | 10 sec |

Figure 12:
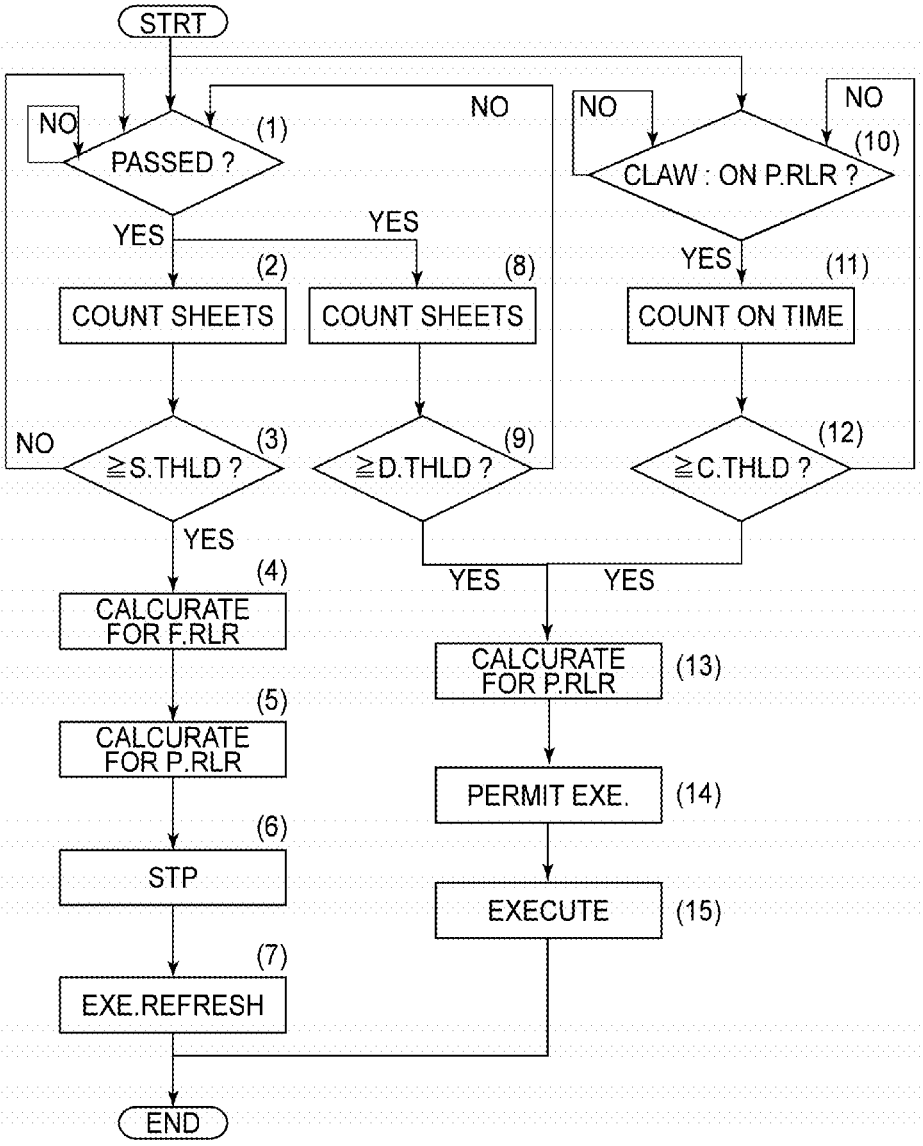
FIG. 12 is a flowchart of the control sequence which the fixing device is made to carry out by the control device, when the image forming apparatus is in the automatic mode.

Referring to FIG. 12, steps (1)-(7) make up the refreshment sequence for nullifying the paper edge scars of the fixation roller 40, and steps (1), (8), (9) and (13)-(15) make up the refreshment sequence for scraping away paper dust, and the like contaminants, from the pressure roller 41. Further, steps (10)-(15) make up the refreshment sequence for nullifying the separation claw scars which are attributable to the contact between the pressure roller 41 and separation claws 71.

As a printing operation is started, whether or not a sheet P of recording paper has moved through the fixing device 9 is detected, in step (1). Then, the number of times a sheet P of recording paper moved through the fixing device 9 is counted by the counter 100 (FIG. 13) in step (2). This counter 100 is controlled in such a manner that the value by which the value in the counter 100 is increased is varied based on the width (length in terms of recording paper conveyance direction) of the sheet P. More concretely, if a sheet P of recording paper is of size A4 (210 mm), the value in the counter 100 is increased by +1, and if a sheet P of recording paper is of size A3 (420 mm), which is equivalent to two sheets of size A4, the value in the counter 100 is increased by +2. Then, if the value in one of the counters 100 exceeds a threshold value, step (4) is taken to initiate the fixation roller refreshment sequence. If the value is no more than the threshold value, steps (1)-(3) are repeated as long as the on-going printing operation continues.

After the completion of step (1), step (8) also is carried out, independently from the above described steps (sequences), for the following reason. That is, step (8) is for dealing with the roller contamination by paper dust. Thus, the number of times sheets P of recording paper which have just been heated for image fixation move through the fixing device 9 was counted regardless of sheet width (size). As in step (2), a value equivalent to the count of sheets of size A4 is added to the value in the counter 100.

If the value in the counter 100 is no less than the threshold value, in step (9), step (13) is taken. Incidentally, steps (4)-(7) may be taken as they are taken from step (3). In this case, however, the on-going print job has to be interrupted, which results in the reduction in productivity of the printer. Therefore, the operation for refreshing the pressure roller 41 is desired to be carried out without interruption of the on-going printing operation as long as it is possible.

Step (10) also is independently carried out right after the starting of a printing operation, for the following reason. That is, this step is for dealing with the separation claw scars. The reason why this step is carried out regardless of the number of times sheets P of recording paper were conveyed through the fixing device 9 is that the extent of the scars attributable to the contact between the pressure roller 41 and separation claws 71 is related to how long the pressure roller 41 rotated in contact with the separation claws. That is, in a case where the pressure roller 41 remains constant in peripheral velocity, the length the separation claws 71 moved along the peripheral surface of the pressure roller 41 in contact with the peripheral surface of the pressure roller 41, is proportional to the progression of the deterioration (separation claw scars) of the peripheral surface of the pressure roller 41.

The separation claws 71 come into contact with the pressure roller 41 before a sheet P of recording paper is discharged from the fixation nip. Then, they remain in contact with the pressure roller 41 until the sheet P moves out of the fixation nip. In this case, there is not the so-called proportional relationship between the number of sheets of recording paper having moved through the fixation nip and the length of time the separations claw 71 were in contact with the pressure roller 41. Instead, the extent of separation claw scar is affected by the length of time (distance) it takes for sequentially conveyed two sheets P of recording paper to move through the fixation nip, and/or the number of prints (images) to be formed in a given printing job. Further, in some cases, it is only when the leading edge of a sheet P of recording paper comes out of the fixation nip that the separation claws 71 are required to be in contact with the pressure roller 41, although it depends on the structure of a given fixing device. In such a case, the length of time the separation claws 71 are required to be in contact with the pressure roller 41 is relatively shorter, with reference to the number of sheets P of recording paper having moved through the fixation nip.

A counter which is based purely on the number of sheets P of recording paper having moved through the fixation nip may be employed. However, controlling the refreshing operation based on the length of time the pressure roller 41 rotated while the separation claws 71 were in contact with the pressure roller 41 is more precise than otherwise. This is why the value in a duration counter is increased only by the length of time the pressure roller 41 rotates while the separation claws 71 are in contact with the pressure roller 41, in step (11). Then, if the value in the duration counter is no less than the threshold value in step (12), step (13) and thereafter are taken to carry out the refreshing operation while images are being formed, as they are taken from step (9).

Next, the sequence made up of steps (4)-(7), and the sequence made of steps (13)-(15), are described. Steps (4)-(7) are such steps that are to be carried out after the on-going printing is interrupted. In step (4), the length of time the fixation roller 40 is to be refreshed (abraded) is calculated based on the value in each counter. The objective of the fixation roller refreshing operation is to deal with the paper edge scars. Therefore, the length of time the fixation roller 40 is to be refreshed is set based on the condition of the portion of the peripheral surface of the fixation roller 40 which have the severest paper edge scars. In this embodiment, the threshold value is 3,000. Therefore, the fixation roller refreshing operation is carried out for 60 seconds.

Next, the length of time the pressure roller 41 is to be refreshed is calculated in step (5). In a case where the on-going printing operation is interrupted for the fixation roller refreshing operation, the pressure roller refreshing operation may be carried out at the same time, because carrying out the pressure roller refreshing operation at the same time as the fixation roller refreshing operation does not have an additional effect upon productivity.

Of course, it is not mandatory that the pressure roller 41 is refreshed with the above described timing. That is, the pressure roller 41 may be refreshed without interrupting the on-going printing operation. However, there are cases in which the pressure roller refreshing operation cannot be carried out during a printing operation, for example, such cases as where printing operations for outputting only a small number of prints (images) are carried out one after another. This is why the pressure roller refreshing operation is to be carried out whenever it can be. As soon as the length of time the fixation roller 40 is to be refreshed, and the length of time the pressure roller 41 is to be refreshed, are calculated, the on-going printing operation is interrupted in step (6). Then, as soon as the sheet P of recording paper in the fixing device 9 comes out of the fixing device 9, the fixation roller refreshing operation and pressure roller refreshing operation are carried out in step (7).

In comparison, in the case of the sequence comprising steps (13)-(15), the refreshing operations are carried out without interrupting the on-going printing operation. More specifically, in step 13), the length of time necessary for the pressure roller refreshing operation is calculated based on the value in the sheet counter and duration counter. Then, in step (14), it is permitted to carry out the pressure roller refreshing operation. Then, the pressure roller refreshing operation is carried out in step (15).

12. User Mode

Figure 14:
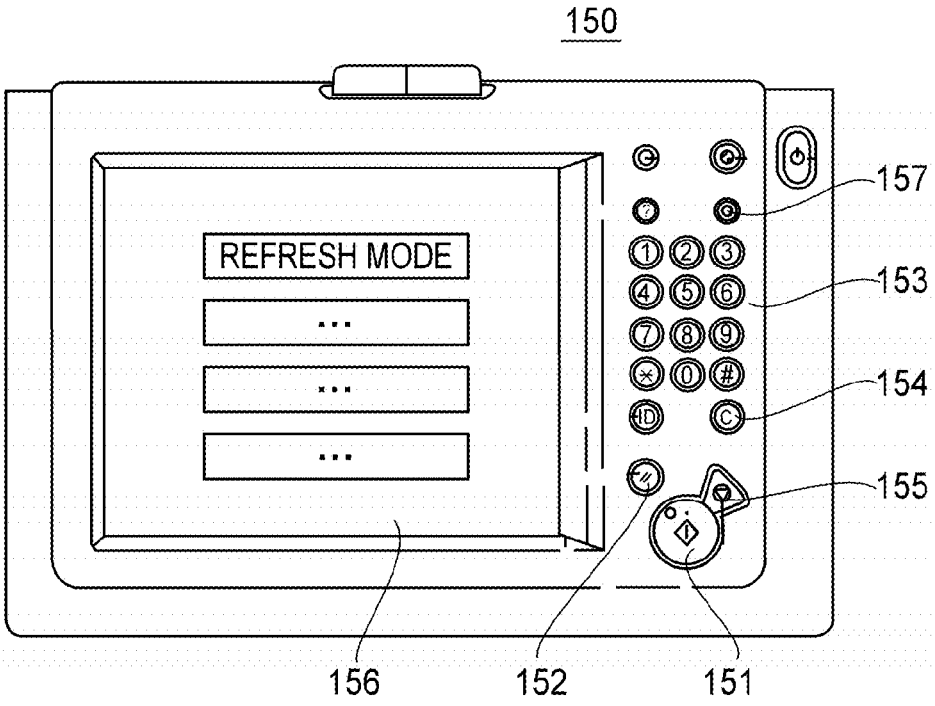
FIG. 14 is a drawing of the control panel of the image forming apparatus equipped with the control device for controlling its fixing device.

In this embodiment, a user mode is provided in addition to an automatic mode, in order to allow a user to perform a refreshing operation whenever the user notices that the image forming apparatus 100 began to output images which are nonuniform in gloss. FIG. 14 is a drawing of the control panel 150 of the image forming apparatus 100.

A referential code 151 stands for a print start button for commanding the image forming apparatus 100 to start a printing operation; 152, a reset bottom for resetting the image forming apparatus 100 to the initial mode; 153, a numerical input section (ten key section) for inputting numerical values such as the number of prints to be formed; 154, a clear button for clearing the numerical input section of the inputted numerical value; 155, a stop button for interrupting the on-going printing operation; 156, a touch panel for setting various operational modes, and also, for showing the print condition; and a referential code 157 is a user mode button for selecting the user mode.

Figure 15:
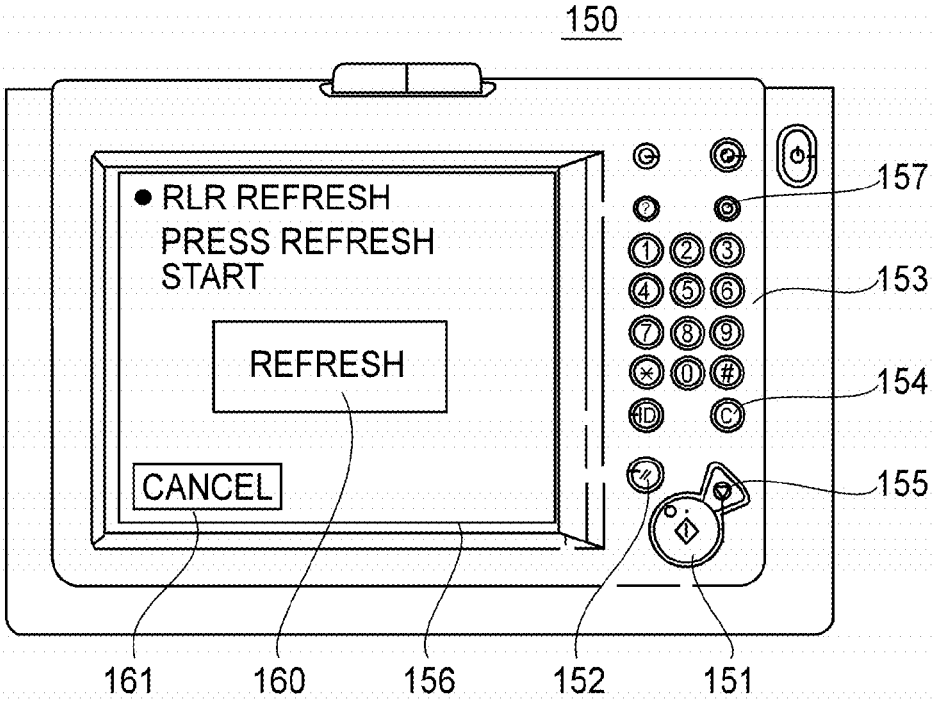
FIG. 15 is a drawing of the control panel of the image forming apparatus equipped with the controlling device for controlling its fixing device, when the display of the control panel is showing the user mode screen.

As a user presses the user mode button 157, mode section bars are displayed on the touch panel 156, as shown in FIG. 14. As the user selects a refresh mode bar, for example, on the touch panel 156 of the control panel, the screen displayed on the touch panel 156 turns into a refresh UI (user interface) screen, as shown in FIG. 15. Then, as the user touches the refresh key 106, a signal for the command for making the image forming apparatus 100 (fixing device 9) operate in the mode for improving the apparatus (device) in image gloss is inputted into the CPU 81. As soon as the CPU 81 receives this signal, it makes the image forming apparatus 100 (fixing device 9) carry out the refreshing operations, which will be described later. By the way, if the user wants to go back from the refresh UI screen to the user mode, the user is to touch a cancel button 161.

13. Refreshing Operation (Abrading Operation) in User Mode

Figure 1:
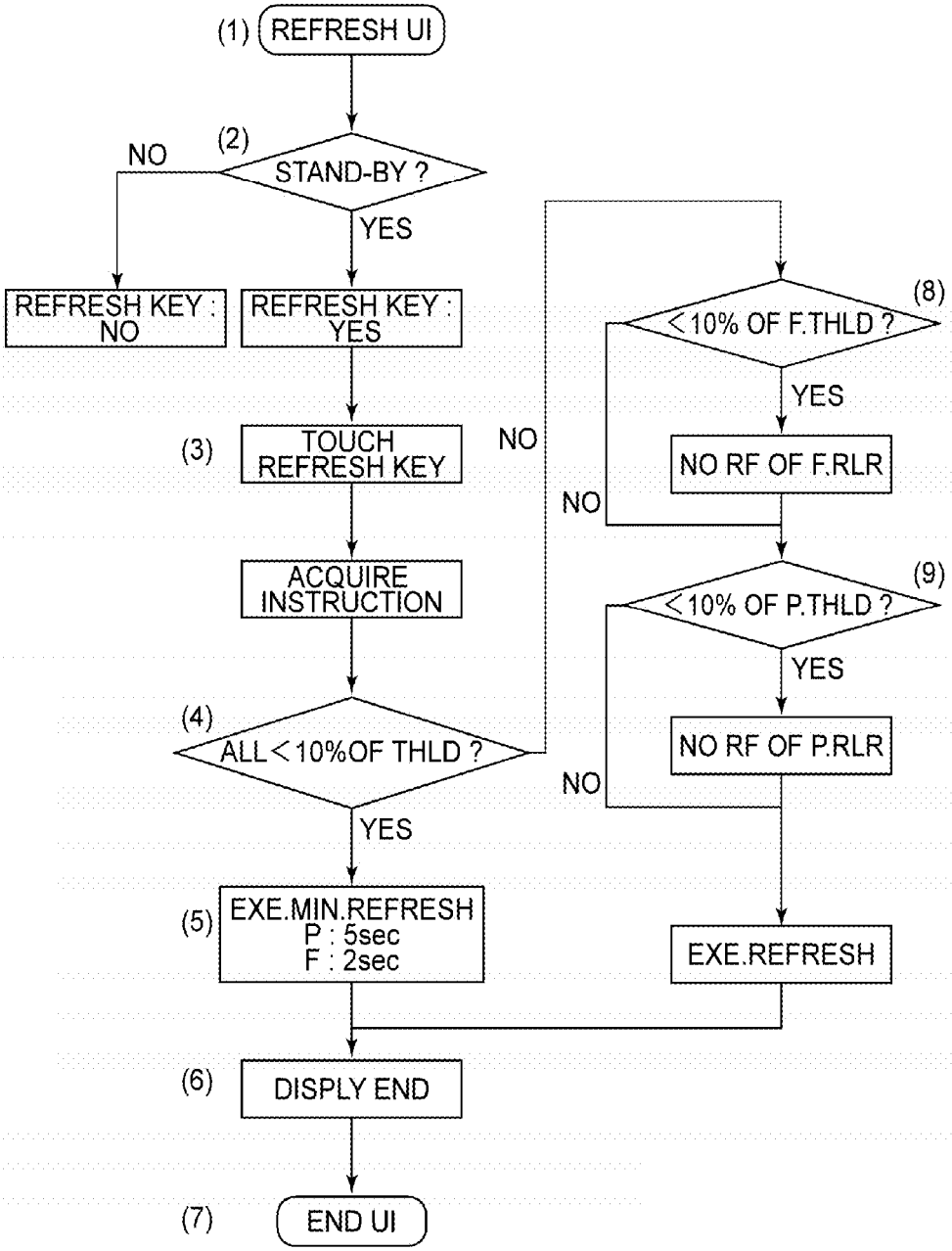
FIG. 1 is a flowchart of the control sequence which is to be carried out when an image forming apparatus equipped with an apparatus for controlling a fixing device is in the user mode (manual mode).

Next, referring to the flowchart in FIG. 1, the operational sequence carried out when the image forming apparatus 100 (fixing device 9) is in the user mode is described. While the refresh UI screen is on the touch panel 156 in step (1), it is allowed to perform the refreshing operations, as long as the image forming apparatus 100 is on standby, in step (2). Next, as the refresh key 160 as a command obtaining section (inputting means) for obtaining the command for making the image forming apparatus 100 operate in the mode for improving the image forming apparatus 100 in image gloss is pressed, in step (3), the following sequences, and/steps, are carried out. That is, the CPU 81 (FIG. 13), which functions also as a decision making section, confirms (obtains) the value in the refresh counter, in order to decide whether or not the fixation roller 40 and/pressure roller 41 is to be refreshed, in step (4).

Here, the refresh counter is the sheet counter 100, the value in which is compared with the threshold value to decide whether or not the fixation roller 40 is to be refreshed in the above described first roller refreshment sequence (automatic mode). It is also the sheet counter, the value in which is compared with the threshold value to decide whether or not the pressure roller refreshing operation is to be carried out in the roller refreshing second operation. Further, it is the duration counter, the value in which is compared with the threshold value to decide whether or not the pressure roller refreshing operation is to be carried out in the roller refreshing third sequence.

If the values in all the refresh counters are no more than 10% of the threshold values when the refresh key 160 was pressed, in step (5), the fixation roller 40 and pressure roller 41 are refreshed for the shortest length of times in Table 3. That is, the fixation roller 40 and pressure roller 41 are refreshed for 5 seconds and 2 seconds, respectively.

Here, the reason why both rollers 40 and 41 are refreshed (abraded) is that it is not clear that which of the fixation roller 40 and pressure roller 41 is to be refreshed, and also, it is thought that there is a connection between carrying out both the fixation roller refreshing operation and pressure roller refreshing operation, instead of not carrying out, and the improvement in fixation. Thereafter, in step (6), the refresh key 160 on the refresh UI screen is dimmed, and the operation in the refresh mode is ended in step (7). Once the refresh key 160 is dimmed, it does not occur that the image forming apparatus 100 is operated in the refresh mode, regardless of how many times and how hard the user touches the refresh key 160, since the image forming operation has been interrupted. That is, the refreshing operations are not going to be carried out until the user mode button 157 is pressed again. If an image forming operation is carried out after the completion of the operation in the refresh mode, the refresh mode key 160 is highlighted again to allow the user to input a command for making the image forming apparatus 100 operate in the refresh mode.

On the other hand, as the refresh key 160 is pressed, the value in the refresh counter is confirmed in step. If the value in one of the refresh counters is no less than the threshold value, it is decided whether or not the fixation roller 40 and pressure roller 41 are to be refreshed in step (4). That is, the sequence for deciding whether or not the value in the refresh counter for the fixation roller 40 is no more than 10% of the threshold value is decided in step (8), and the sequence for deciding whether or not the value in the refresh counter for the pressure roller 41 is no more than 10% of the threshold value, are carried out in step (9).

If the value in the refresh counter for the fixation roller 40 is no more than 10% of the threshold value, the fixation roller refreshing operation is prohibited, and only the pressure roller is refreshed (abraded). On the other hand, the value in the refresh counter for the pressure roller refreshing operation is no more than 10% of the threshold value for the pressure roller refreshing operation, only the fixation roller refreshing operation is carried out; the pressure roller refreshing operation is prohibited. The reason why only one of the two rollers 40 and 41 is prevented from being refreshed is that it is clear that which is to be refreshed, the fixation roller 40 or pressure roller 41, and therefore, only the roller to be refreshed is refreshed to prevent the other roller from reduced in service life, by being subjected to a refreshing operation.

On the other hand, if the values in the refresh counter for the fixation roller 40 and the value in the refresh counter for the pressure roller 41 are no less than the threshold values, both the fixation roller refreshing (abrading) operation, and the pressure roller refreshing (abrading) operation, are carried out. The lengths of time these refreshing operations are to be carried out are given in Table 3. That is, when the refresh key 160 is pressed, if value in the sheet counter based on sheet width is between 300 and 3000, the fixation roller 40 is abraded for a length of time between 5 to 60 seconds, based on the value in the counter.

Further, when the refresh key 160 is pressed, if the value in the sheet counter is between 50-500, or the length of time the separation claws were in contact with the pressure roller 41 is between 30 seconds to 300 seconds, the pressure roller refreshing operation is carried out for a length of time (second) between 2 seconds to 10 seconds, based on the value in the counter. By the way, regarding the length of time (in second) the refreshing operation is to be carried, the length may be set in a manner of stair steps so that the greater the value in the counter, the longer the refreshing operation is to be carried out.

TABLE 3

<Threshold: less than 10%>

| | | threshold | Execution duration per one |
|---|---|---|---|
| Fixing roller | Width counter | 300 sheets | 5 sec |
| Pressing roller | Passed sheet counter | 50 sheets | 2 sec |
| | Claw-on time counter | 30 sec | 2 sec |

TABLE 3-continued

| <Threshold: not less than 10%> | | | |
|---|---|---|---|
| | | threshold | Execution duration per one |
| Fixing roller | Width counter sheets | - 3000 | - 60 sec |
| Pressing roller | Passed sheet counter | - 500 sheets | - 10 sec |
| | Claw-on time counter | - 300 sec | - 10 sec |

After the completion of the refreshing operations, the refresh counter for the roller for which the refreshing (abrading) operation was carried out is set to zero. That is, in a case where the rotational component for which the abrading operation is carried out is the fixation roller 40, the paper width counter is reset to zero. On the other hand, in a case where the rotational component for which the abrading operation is carried out is pressure roller 41, the sheet counter and separation claw contact time counter are reset to zero. Then, the highlighted refresh key 160 of the refresh UI screen is dimmed (darkened) in step (6), and the operation in refresh mode is ended in step (7).

As described above, in the user mode, the CPU 81 decides which, or both, of the fixation roller 40 and pressure roller 41 is to be refreshed. Then, it automatically decides (sets) the length of abrading time, so that the length of abrading time matches the extent to which the roller(s) is to be abraded. Thus, all that is necessary for the fixation roller 40 and/or pressure roller 41 to be optimally refreshed is for a user to press the refresh key 160. Thus, it does not occur that a wrong roller is selected to be refreshed, and also, the refreshing operation can be simply and accurately carried out.

14. Maintenance Mode

Figure 16:
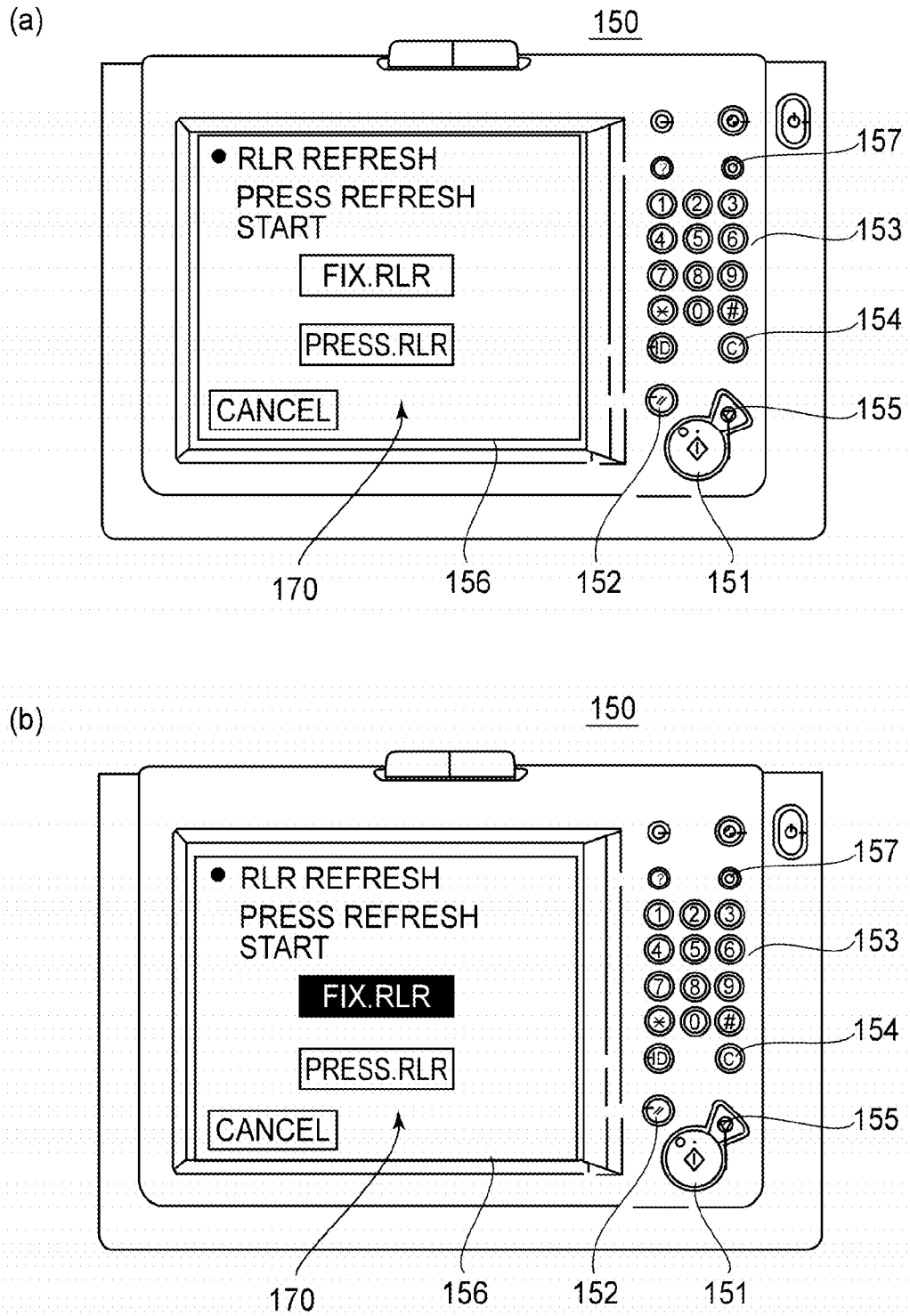
FIG. 16 is a drawing of the control panel of the image forming apparatus equipped with the controlling device for controlling its fixing device, when the display of the control panel is showing the maintenance mode screen.

In this embodiment, the image forming apparatus 100 is provided with a maintenance mode in order to enable a maintenance engineer to operate the image forming apparatus 100 in the maintenance mode, which is for testing and maintaining the image forming apparatus 100. Referring to FIG. 16(*a*), as a maintenance engineer inputs his or her password with the use of the numerical input section 153, the maintenance mode is highlighted on the touch screen.

A maintenance engineer is to examine the surface condition of the surface layer of the fixation roller 40 as well as the pressure roller 41, to find out which refreshing operation is to be carried out. Then, the engineer is to press the button, on the screen 170, which indicates the roller to be refreshed, to refresh the roller. In this embodiment, the length of time each refreshing operation is to be carried out was set to the minimum length of time in Table 3. Then, the engineer is to repeat the refreshing operation while examining the images outputted by the image forming apparatus 100, in order to improve each roller in surface condition.

In a case where the value in one of the counters will have reached refresh rollers 52 and/or 62 will have reached the preset value for roller replacement, the button which represents the roller to be replaced, will be dimmed, as shown in FIG. 16(*b*).

As described above, the image forming apparatus 100 in this embodiment is provided with the maintenance mode in order to enable a maintenance engineer to perform the refreshing operations. Thus, the fixation roller 40 and pressure roller 41 can be maintained at a satisfactory level in terms of the surface condition of their surface layer. Further, it can be easily decided whether the refreshing rollers 52 and 62 need to be replaced.

(Effects of Present Embodiment)

According to present invention, all that is necessary for a user to do to decide whether or not the surface layer of the fixation roller 40 and/or pressure roller 41 needs to be refreshed is for the user to select the user mode and press a single button, that is, the button for automatically deciding which, or both, of the fixation roller 40 and pressure roller 41 need to be refreshed. Therefore, it is possible to prevent the problem that the surface layer of the fixation roller 40 and/or pressure roller 41 is excessively abraded due to the error in the selection of the roller(s) to be refreshed, and/or excessive refreshing of the roller(s).

(Modifications)

In the foregoing, one of the preferable embodiments of the present invention was described. However, the preceding embodiment is not intended to limit the present invention in scope. That is, the present invention is also applicable to various modified version of the image forming apparatus, and fixing device, in the preceding embodiment, within the scope of the present invention.

(Modification 1)

In the preceding embodiment described above, the user mode, which is to be selected by a user, is provided, in addition to the automatic mode which does not require an instruction from a user. However, the preceding embodiment is not intended to limit the present invention in terms of the user mode. For example, the present invention is also applicable to an image forming apparatus and its fixing device structured so that as a user inputs an instruction, with the use of the UI screen or PC screen, to make the apparatus carry out a refreshing operation, the apparatus automatically decides which roller is to be refreshed, and carries out the refreshing operation for the selected roller. For example, in a case where an image forming apparatus is a printer which does not have a control panel, a refresh mode command transmitted from a host computer is inputted into the CPU 81 of the image forming apparatus, provided that the printer is in connection to the host computer (PC), wirelessly or through LAN cable. The operational sequences hereafter are the same as those in the above-described embodiment.

Regarding the mode (refresh mode) for improving an image forming apparatus in image gloss, it may be for restoring the image forming apparatus by 80%-90%, in image gloss, relative to the initial condition, instead of restoring (refreshing) to 100%. That is, all that is necessary here is that operating an image forming apparatus in the refresh mode improves the apparatus in image gloss.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 215387/2013 filed Oct. 16, 2013, which is hereby incorporated by reference.

What is claimed is:

1. A controlling apparatus for controlling an image heating device, the image heating device including first and second rotatable members for heating therebetween a toner image on a sheet, a first rubbing rotatable member for rubbing the first rotatable member, and a second rubbing rotatable member for rubbing the second rotatable member, said controlling apparatus comprising:

a counter configured to count a number of heated sheets;

a first executing portion configured to execute rubbing by the first rubbing rotatable member in accordance with an output of said counter;

a second executing portion configured to execute rubbing by the second rubbing rotatable member in accordance with an output of said counter;

an acquiring portion configured to acquire an execution instruction for operation in an image glossiness property improving mode provided by an operator; and a determination portion configured to determine whether one or both of the first and second rotatable members is to be rubbed in accordance with an output of said counter when said acquiring portion acquires the execution instruction.

2. A controlling apparatus according to claim 1, wherein said determination portion determines such that, at the time when acquiring portion acquires the execution instruction, when (i) a number of sheets counted by said counter from previous execution of rubbing by the first rubbing rotatable member is less than a predetermined number and (ii) a number of sheets counted by said counter from previous execution of rubbing by the second rubbing rotatable member is not less than a predetermined number, the rubbing by the first rubbing rotatable member is executed, whereas the rubbing by the second rubbing rotatable member is not executed.

3. A controlling apparatus according to claim 1, wherein said determination portion determines such that, at the time when acquiring portion acquires the execution instruction, when (i) a number of sheets counted by said counter from previous execution of rubbing by the first rubbing rotatable member is not less than a predetermined number and (ii) a number of sheets counted by said counter from previous execution of rubbing by the second rubbing rotatable member is less than a predetermined number, the rubbing by the second rubbing rotatable member is executed, whereas the rubbing by the first rubbing rotatable member is not executed.

4. A controlling apparatus according to claim 1, wherein said determination portion determines such that, at the time when acquiring portion acquires the execution instruction, when (i) a number of sheets counted by said counter from previous execution of rubbing by the first rubbing rotatable member is less than a predetermined number and (ii) a number of sheets counted by said counter from previous execution of rubbing by the second rubbing rotatable member is less than a predetermined number, the rubbing by the first rubbing rotatable member and the rubbing by the second rubbing rotatable member are executed.

5. A controlling apparatus according to claim 1, wherein said determination portion is capable of changing a duration of the rubbing by the first rubbing rotatable member in accordance with an output of said counter when said determination portion determines the execution of the rubbing by the first rubbing rotatable member, and said determining portion is capable of changing a duration of the rubbing by the second rubbing rotatable member in accordance with an output of said counter when said determination portion determines the execution of the rubbing by the second rubbing rotatable member.

6. A controlling apparatus according to claim 1, wherein said first executing portion executes the rubbing by the first rubbing rotatable member when the number of sheets counted by said counter is not less than a first number, and said second executing portion executes the rubbing by the second rubbing rotatable member when a number of sheets counted by said counter is not less than a second number that is different from the first number.

7. An image heating apparatus comprising:

first and second rotatable members configured to heat therebetween a toner image on a sheet;

a first rubbing configured to rub said first rotatable member;

a second rubbing rotatable member configured to rub said second rotatable member;

a counter configured to count a number of heated sheets;

a first executing portion configured to execute rubbing by said first rubbing rotatable member in accordance with an output of said counter;

a second executing portion configured to execute rubbing by said second rubbing rotatable member in accordance with an output of said counter;

an acquiring portion configured to acquire an execution instructions for operation in an image glossiness property improving mode provided by an operator; and a determination portion configured to determine whether one or both of said first and second rotatable members is to be rubbed in accordance with an output of said counter when said acquiring portion acquires the execution instruction.

8. An apparatus according to claim 7, wherein said determination portion determines such that, at the time when acquiring portion acquires the execution instruction, when (i) a number of sheets counted by said counter from previous execution of rubbing by said first rubbing rotatable member is less than a predetermined number and (ii) a number of sheets counted by said counter from previous execution of rubbing by said second rubbing rotatable member is not less than a predetermined number, the rubbing by said first rubbing rotatable member is executed, whereas the rubbing by said second rubbing rotatable member is not executed.

9. An apparatus according to claim 7, wherein said determination portion determines such that, at the time when acquiring portion acquires the execution instruction, when (i) a number of sheets counted by said counter from previous execution of rubbing by said first rubbing rotatable member is not less than a predetermined number and (ii) a number of sheets counted by said counter from previous execution of rubbing by said second rubbing rotatable member is less than a predetermined number, the rubbing by said second rubbing rotatable member is executed, whereas the rubbing by said first rubbing rotatable member is not executed.

10. An apparatus according to claim 7, wherein said determination portion determines such that at the time when acquiring portion acquires the execution instruction, when (i) a number of sheets counted by said counter from previous execution of rubbing by said first rubbing rotatable member is less than a predetermined number and (ii) a number of sheets counted by said counter from previous execution of rubbing by said second rubbing rotatable member is less than a predetermined number, the rubbing by said first rubbing rotatable member and the rubbing by said second rubbing rotatable member are executed.

11. An apparatus according to claim 7, wherein said determination portion is capable of changing a duration of the rubbing by said first rubbing rotatable member in accordance with an output of said counter when said determination portion determines the execution of the rubbing by said first rubbing rotatable member, and said determining portion is capable of changing a duration of the rubbing by said second rubbing rotatable member in accordance with an output of said counter when said determination portion determines the execution of the rubbing by said second rubbing rotatable member.

12. An apparatus according to claim 7, wherein said first executing portion executes the rubbing by said first rubbing rotatable member when the number of sheets counted by said counter is not less than a first number, and said second executing portion executes the rubbing by said second rubbing rotatable member when a number of sheets counted by said counter is not less than a second number that is different from the first number.

13. An image forming apparatus comprising:

an image forming station configured to form a toner image on a sheet;

first and second rotatable members configured to heat therebetween the toner image formed by said image forming station on the sheet;

a first rubbing configured to rub said first rotatable member;

a second rubbing rotatable member configured to rub said second rotatable member;

a counter configured to count a number of heated sheets;

a first executing portion configured to execute rubbing by said first rubbing rotatable member in accordance with an output of said counter;

a second executing portion configured to execute rubbing by said second rubbing rotatable member in accordance with an output of said counter;

an operating portion configured to instruct, by an operator, execution of an operation in a mode for improving a glossiness property of the toner image; and a determination portion configured to determine whether one or both of said first and second rotatable members is to be rubbed in accordance with an output of said counter when execution of the operation in the mode is instructed by said operating portion.

14. An apparatus according to claim 13, wherein said determination portion determines such that, at the time when the execution of the operation in the mode is instructed on said operating portion, when (i) a number of sheets counted by said counter from previous execution of rubbing by said first rubbing rotatable member is less than a predetermined number and (ii) a number of sheets counted by said counter from previous execution of rubbing by said second rubbing rotatable member is not less than a predetermined number, the rubbing by said first rubbing rotatable member is executed, whereas the rubbing by said second rubbing rotatable member is not executed.

15. An apparatus according to claim 13, wherein said determination portion determines such that, at the time when the execution of the operation in the mode is instructed on said operating portion, when (i) a number of sheets counted by said counter from previous execution of rubbing by said first rubbing rotatable member is not less than a predetermined number and (ii) a number of sheets counted by said counter from previous execution of rubbing by said second rubbing rotatable member is less than a predetermined number, the rubbing by said second rubbing rotatable member is executed, whereas the rubbing by said first rubbing rotatable member is not executed.

16. An apparatus according to claim 13, wherein said determination portion determines such that, at the time when the execution of the operation in the mode is instructed on said operating portion, when (i) a number of sheets counted by said counter from previous execution of rubbing by said first rubbing rotatable member is less than a predetermined number and (ii) a number of sheets counted by said counter from previous execution of rubbing by said second rubbing rotatable member is less than a predetermined number, the rubbing by said first rubbing rotatable member and the rubbing by said second rubbing rotatable member are executed.

17. An apparatus according to claim 13, wherein said determination portion is capable of changing a duration of the rubbing by said first rubbing rotatable member in accordance with an output of said counter when said determination portion determines the execution of the rubbing by said first rubbing rotatable member, and said determining portion is capable of changing a duration of the rubbing by said second rubbing rotatable member in accordance with an output of said counter when said determination portion determines the execution of the rubbing by said second rubbing rotatable member.

18. An apparatus according to claim 13, wherein said first executing portion executes the rubbing by said first rubbing rotatable member when the number of sheets counted by said counter is not less than a first number, and said second executing portion executes the rubbing by said second rubbing rotatable member when a number of sheets counted by said counter is not less than a second number that is different from the first number.

* * * * *